US008626041B2

(12) United States Patent
Tominaga et al.

(10) Patent No.: US 8,626,041 B2
(45) Date of Patent: Jan. 7, 2014

(54) IMAGE FORMING APPARATUS AND CONTROL METHOD THEREOF

(75) Inventors: Hidekazu Tominaga, Kawasaki (JP); Shuuhei Hamada, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 586 days.

(21) Appl. No.: 12/894,761

(22) Filed: Sep. 30, 2010

(65) Prior Publication Data

US 2011/0085827 A1 Apr. 14, 2011

(30) Foreign Application Priority Data

Oct. 8, 2009 (JP) ..... 2009-234644

(51) Int. Cl.
*G03G 15/01* (2006.01)
*G03G 15/00* (2006.01)

(52) U.S. Cl.
USPC ..... 399/301; 399/167

(58) Field of Classification Search
USPC ..... 399/46, 51, 301, 167
See application file for complete search history.

(56) References Cited

U.S. PATENT DOCUMENTS

| | | | | |
|---|---|---|---|---|
| 4,752,804 | A | 6/1988 | Ohno | |
| 5,995,802 | A | 11/1999 | Mori et al. | |
| 6,049,690 | A | 4/2000 | Nakayasu et al. | |
| 6,070,041 | A | 5/2000 | Nakayasu et al. | |
| 6,336,024 | B1 * | 1/2002 | Kanaya et al. | 399/301 |
| 7,280,789 | B2 * | 10/2007 | Iwasaki | 399/301 X |
| 7,636,540 | B2 * | 12/2009 | Sakai | 399/301 |
| 2007/0048017 | A1 * | 3/2007 | Kiryu | 399/167 |
| 2007/0196132 | A1 * | 8/2007 | Kobayashi et al. | 399/167 |
| 2007/0253736 | A1 * | 11/2007 | Ehara et al. | 399/167 |

FOREIGN PATENT DOCUMENTS

| | | | |
|---|---|---|---|
| JP | 62059977 | A | 3/1987 |
| JP | 10333398 | A | 12/1998 |
| JP | 2000-172148 | A | 6/2000 |
| JP | 2000250284 | A | 9/2000 |
| JP | 3186610 | B2 | 7/2001 |
| JP | 2004317538 | A | 11/2004 |
| JP | 2009-128811 | A | 6/2009 |

OTHER PUBLICATIONS

Office Action mailed Aug. 5, 2013, in Japanese Patent Application No. 2009-234644, Japanese Patent Office.

* cited by examiner

*Primary Examiner* — Sandra Brase
(74) *Attorney, Agent, or Firm* — Fitzpatrick, Cella, Harper & Scinto

(57) ABSTRACT

This invention provides an image forming apparatus capable of effectively suppressing an AC color registration error, and a control method thereof. To accomplish this, the image forming apparatus according to this invention controls driving of a transfer belt so that the speed of surface of the transfer belt at the transfer position comes close to a constant speed. The image forming apparatus also controls driving of a photosensitive drum so that the error between the speed of surface of the photosensitive drum and that of the transfer belt at the transfer position becomes almost 0. Further, the image forming apparatus controls the exposure timing in accordance with fluctuations of the speed of surface at the exposure position so that the exposure interval in the sub-scanning direction on the photosensitive drum comes close to a constant interval.

8 Claims, 21 Drawing Sheets

FIG. 12

| SUB-SCANNING POSITION [dot] | ACCUMULATED POSITION ERROR [μm] | BD FREQUENCY [Hz] | BD CYCLE [μ sec] | PIXEL CLK [MHz] |
|---|---|---|---|---|
| 1 | 0.2 | 3591.8 | 278.4 | 50.9 |
| 2 | 0.4 | 3591.8 | 278.4 | 50.9 |
| ... | ... | ... | ... | ... |
| 889 | 99.9 | 3562.2 | 280.7 | 50.5 |
| 890 | 99.9 | 3562.1 | 280.7 | 50.5 |
| ... | ... | ... | ... | ... |
| 1779 | 0.2 | 3532.4 | 283.1 | 50.1 |
| 1780 | 0.0 | 3532.4 | 283.1 | 50.1 |
| ... | ... | ... | ... | ... |
| 2670 | −100.1 | 3562.0 | 280.7 | 50.5 |
| 2671 | −100.1 | 3562.1 | 280.7 | 50.5 |
| ... | ... | ... | ... | ... |
| 3561 | −0.2 | 3591.8 | 278.4 | 50.9 |
| 3562 | 0.0 | 3591.8 | 278.4 | 50.9 |

| SUB-SCANNING POSITION [dot] | ACCUMULATED POSITION ERROR 1 [μm] | ACCUMULATED POSITION ERROR 2 [dot] | ACCUMULATED POSITION ERROR 3 [dot] | | BD CYCLE [μ sec] | PIXEL CLK [MHz] |
|---|---|---|---|---|---|---|
| 1 | 0.18 | 0.008 | 0 | 0.008 | 3562.1 | 50.5 |
| 2 | 0.35 | 0.017 | 0 | 0.017 | 3562.1 | 50.5 |
| ... | ... | ... | ... | ... | ... | ... |
| 889 | 99.91 | 4.720 | 4 | 4.720 | 3562.1 | 50.5 |
| 890 | 99.91 | 4.720 | 4 | 4.720 | 3562.1 | 50.5 |
| ... | ... | ... | ... | ... | ... | ... |
| 1779 | 0.19 | 0.009 | 0 | 0.009 | 3562.1 | 50.5 |
| 1780 | 0.01 | 0.001 | 0 | 0.001 | 3562.1 | 50.5 |
| ... | ... | ... | ... | ... | ... | ... |
| 2670 | −100.09 | −4.729 | −5 | −4.729 | 3562.1 | 50.5 |
| 2671 | −100.09 | −4.729 | −5 | −4.729 | 3562.1 | 50.5 |
| ... | ... | ... | ... | ... | ... | ... |
| 3561 | −0.20 | −0.009 | −1 | −0.009 | 3562.1 | 50.5 |
| 3562 | −0.02 | −0.001 | −1 | −0.001 | 3562.1 | 50.5 |

IMAGE FORMING APPARATUS AND CONTROL METHOD THEREOF

BACKGROUND OF THE INVENTION

1. Field of the Invention

The present invention relates to an image forming apparatus such as a copying machine, printer, or facsimile apparatus, and a control method thereof.

2. Description of the Related Art

In general, an electrophotographic image forming apparatus forms an image by transferring and superimposing developing material images (toner images) of respective colors formed on different image carriers (photosensitive drums) onto the surface of an intermediate transfer member (transfer belt) or that of a print material held on a conveyance belt. When transferring and superimposing the developing material images, alignment (registration) is important. In the image forming apparatus, however, the photosensitive drums and transfer belt suffer rotational nonuniformity depending on the device precision or the like. The positions of toner images of respective colors shift in the rotational direction, resulting in color misregistration in the formed image. This problem becomes serious especially in a tandem type color image forming apparatus.

Such position errors (registration errors) are classified as a DC color registration error and AC color registration error. The DC color registration error is a registration error in which the positions of the leading and trailing ends of a formed image in the moving direction do not match owing to rotation of the transfer belt or the like. The AC color registration error is a registration error in which the magnitude or direction of a position error periodically fluctuates mainly due to a rotating member such as the photosensitive drum or belt driving roller. Of these registration errors, the DC color registration error can be suppressed by detecting registration patches of respective colors by a registration sensor, and correcting the leading end position of a formed image or correcting the magnification in the conveyance direction.

For the AC color registration error, there is known an image forming apparatus which detects rotational fluctuations of the rotating member using an encoder attached to the rotating shaft of the photosensitive drum or the like, and feeding forward or back the detection result to the driving motor to reduce the rotational fluctuations. Even by this control, however, the speed of surface of the photosensitive drum fluctuates owing to an eccentric component that is generated from misalignment of the central axes of the photosensitive drum and photosensitive drum driving shaft. Also, the speed of surface of the transfer belt fluctuates due to the eccentricity caused by misalignment of the rotating shaft of the driving roller or the like, and thickness nonuniformity. For the AC color registration error arising from composite factors, the following methods are being examined.

For example, Japanese Patent Laid-Open No. 62-59977 proposes a method of reducing a registration error amount by locking the phases of registration errors caused by the eccentricity of the photosensitive drums of respective image forming units. In this method, however, when the amplitude of the AC component of rotational fluctuations caused by the eccentricity of the photosensitive drum is different between the photosensitive drums, the AC component still remains.

To solve this problem, for example, Japanese Patent Laid-Open No. 2000-250284 proposes a method of suppressing the AC component in one cycle of the photosensitive drum. Japanese Patent Laid-Open No. 10-333398 proposes a method of suppressing the AC component in one cycle of the photosensitive drum, a plurality of cycles until the photosensitive drum is driven, and one cycle of the transfer belt. Japanese Patent No. 3186610 proposes a method of suppressing the AC component by setting the exposure position and transfer position to be opposite to each other by 180° on the photosensitive drum. Japanese Patent Laid-Open No. 2004-317538 proposes a method of forming an electrostatic latent image free from any position error on the photosensitive drum. In this method, the position error amount is estimated from the result of detecting fluctuations of the speed of surface of the photosensitive drum, and the position error is corrected from a displacement amount smaller than the minimum unit of the resolution to an arbitrary displacement amount.

However, these conventional techniques have the following problems. For example, in the methods disclosed in Japanese Patent Laid-Open Nos. 2000-250284 and 10-333398 and Japanese Patent No. 3186610, when the rotational speed of the photosensitive drum is corrected to suppress the AC component of rotational fluctuations, the difference in the speeds of surface between the transfer belt and the photosensitive drum at the transfer position fluctuates with time. Owing to the speed difference, the state of a stick-slip between the transfer belt and the photosensitive drum changes, making it difficult to effectively suppress the AC component. In the method disclosed in Japanese Patent Laid-Open No. 2004-317538, even if electrostatic latent images are formed at constant intervals on the photosensitive drum at the exposure position, a position error is generated in an image transferred onto the transfer belt under the influence of the stick-slip at the transfer position. Therefore, the conventional techniques cannot satisfactorily suppress the AC color registration error generated under the influence of an unpredictable random stick-slip.

SUMMARY OF THE INVENTION

The present invention has been made to solve the conventional problems, and has as its object to provide an image forming apparatus capable of minimizing generation of an unpredictable random stick-slip and effectively suppressing the AC color registration error, and a control method thereof.

One aspect of the present invention provides an image forming apparatus including an image carrier, an exposure unit that forms an electrostatic latent image by exposing a surface of the image carrier based on image data, a developing unit that develops the electrostatic latent image formed on the image carrier with a developing material, and an intermediate transfer member onto which a developing material image developed by the developing unit is transferred, the apparatus comprising: a first detection unit that detects a speed of surface of the intermediate transfer member at a transfer position where the developing material image is transferred from the image carrier to the intermediate transfer member; a first control unit that controls driving of the intermediate transfer member based on a result of detection by the first detection unit so as to make the speed of surface of the intermediate transfer member at the transfer position close to a predetermined target speed; a second detection unit that detects a speed of surface of the image carrier at the transfer position; a second control unit that controls driving of the image carrier based on a result of detection by the second detection unit so as to make the speed of surface of the image carrier at the transfer position close to the same speed as the speed of surface of the intermediate transfer member at the transfer position; a third detection unit that detects a speed of surface of the image carrier at an exposure position where the image carrier is exposed by the exposure unit; and a third control unit that controls a timing of exposure by the exposure unit based on a result of detection by the third detection unit so as to make an interval to expose the image carrier by the exposure unit in a sub-scanning direction, close to a constant interval.

Another aspect of the present invention provides a method of controlling an image forming apparatus including an image carrier, an exposure unit that forms an electrostatic latent image by exposing a surface of the image carrier based on image data, a developing unit that develops the electrostatic latent image formed on the image carrier with a developing material, and an intermediate transfer member onto which a developing material image developed by the developing unit is transferred, the method comprising: detecting a speed of surface of the intermediate transfer member at a transfer position where the developing material image is transferred from the image carrier to the intermediate transfer member; controlling driving of the intermediate transfer member based on a result of detection in the detecting a speed of surface of the intermediate transfer member at a transfer position, so as to make the speed of surface of the intermediate transfer member at the transfer position close to a predetermined target speed; detecting a speed of surface of the image carrier at the transfer position; controlling driving of the image carrier based on a result of detection in the detecting a speed of surface of the image carrier at the transfer position, so as to make the speed of surface of the image carrier at the transfer position close to the same speed as the speed of surface of the intermediate transfer member at the transfer position; detecting a speed of surface of the image carrier at an exposure position where the image carrier is exposed by the exposure unit; and controlling a timing of exposure by the exposure unit based on a result of detection in the detecting a speed of surface of the image carrier at an exposure position, so as to make an interval to expose the image carrier by the exposure unit in a sub-scanning direction, close to a constant interval.

The present invention can provide an image forming apparatus capable of, for example, suppressing generation of an unpredictable random stick-slip and effectively suppressing the AC color registration error, and a control method thereof.

Further features of the present invention will become apparent from the following description of exemplary embodiments (with reference to the attached drawings).

BRIEF DESCRIPTION OF THE DRAWINGS

FIG. 12 is a table exemplifying numerical values in control by the exposure control unit according to the third embodiment;

DESCRIPTION OF THE EMBODIMENTS

Preferred embodiments of the present invention will be described below. The following embodiments would help understand various concepts such as superordinate, intermediate, and subordinate concepts of the invention. The technical scope of the present invention is defined by the scope of the claims, and is not limited by the following embodiments.

First Embodiment

<Arrangement of Image Forming Apparatus>

Figure 1A:
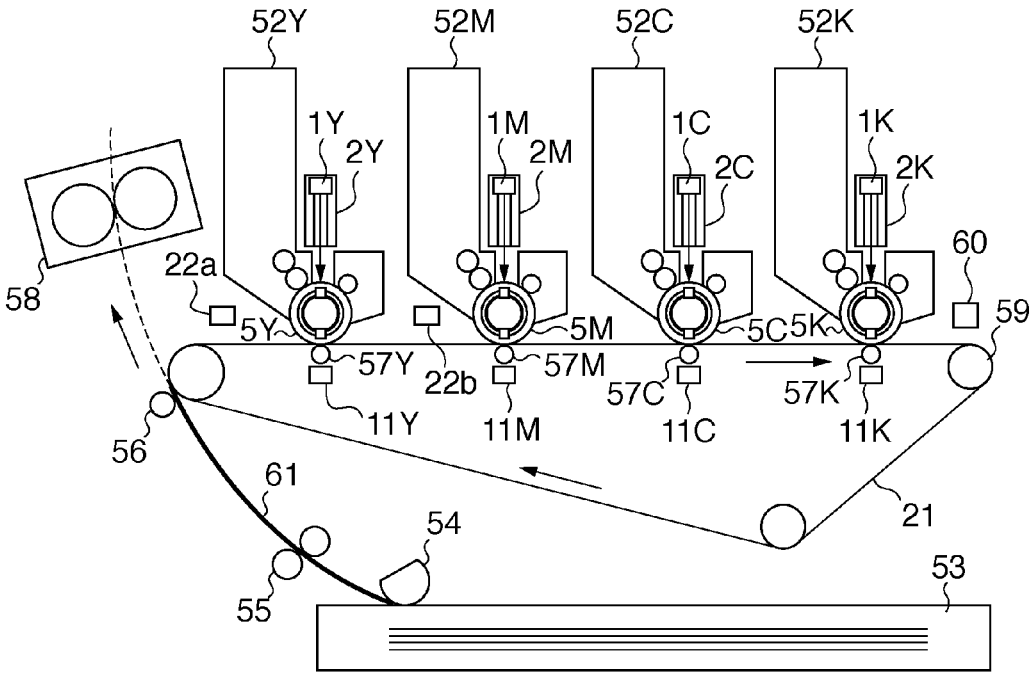
FIGS. 1A, 1B, and 1C are a side sectional view of an image forming apparatus, and enlarged views of a photosensitive drum 5 and its surroundings according to the first embodiment, respectively.

The first embodiment of the present invention will be described with reference to FIGS. 1A to 7, 19A, 19B, and 20. FIG. 1A is a side sectional view exemplifying an image forming apparatus according to the first embodiment. A plurality of rotating rollers including a driving roller 59 keep a transfer belt (intermediate transfer member) 21 taut at the center of the image forming apparatus. The transfer belt 21 is conveyed in a direction indicated by arrows in FIG. 1A. Four drum-like image carriers (photosensitive drums) 5Y, 5M, 5C, and 5K corresponding to toners of yellow (Y), magenta (M), cyan (C), and black (K) are arranged in line to face the conveyance surface of the transfer belt 21.

Four developing portions 52 are arranged in correspondence with the respective colors. Each developing portion 52 includes the photosensitive drum 5, a toner, a charger, and a developing unit. The charger and developing unit are arranged at a predetermined interval in the housing of the developing portion 52. An exposure portion 2 including an LED exposes the outer surface of the photosensitive drum 5 at the interval by emitting a laser beam to it.

Four exposure portions 2 are arranged in correspondence with the developing portions 52 of the respective colors. After each charger uniformly charges the outer surface of a corresponding photosensitive drum 5 with a predetermined amount of charges, the exposure portion 2 exposes the outer surface in accordance with image data. As a result, an electrostatic latent image is formed on the outer surface. The developing unit develops the electrostatic latent image by transferring toner to a low-potential portion of the electrostatic latent image, forming a toner image (developing material image).

Primary transfer members 57 are arranged at positions below the conveyance surface of the transfer belt 21. Toner images formed on the outer surfaces of the respective photosensitive drums 5 are primarily transferred to the surface of the transfer belt 21 by transfer electric fields formed by the corresponding primary transfer members 57. In parallel with the primary transfer to the transfer belt 21, print sheets 61 set in a print sheet cassette 53 at the bottom of the apparatus main body are picked up one by one from the cassette by a crescent pickup roller 54. The print sheet 61 is then conveyed to a secondary transfer portion by a pair of conveyance rollers 55. A secondary transfer member 56 arranged at the secondary transfer portion secondarily transfers the toner image on the transfer belt 21 onto the print sheet 61 conveyed to the secondary transfer portion. A fixing portion 58 formed from a press roller and heat roller fixes the toner image on the print sheet 61 onto the sheet surface by heat. After that, the print sheet 61 is discharged from the apparatus by a discharge roller (not shown). A cleaner (not shown) recovers unnecessary toner left on the transfer belt 21. Then, the image forming unit shifts to the next image forming process.

Prior to a series of image forming processes, the image forming unit forms a registration patch on the transfer belt 21. Also, the image forming unit detects a DC color registration error using a registration detector 60 located above the transfer belt 21. Based on the detection result, the image forming unit controls the exposure timing to correct the DC color registration error.

Note that the embodiment may employ a conveyance belt instead of the transfer belt 21. In this case, the print sheet 61 is chucked, held, and conveyed by the conveyance belt, and toner images of the respective colors are sequentially transferred directly onto the print sheet 61.

Figure 1B:
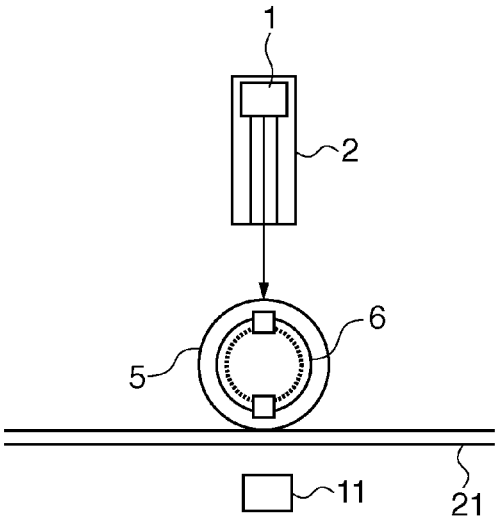
Figure 1C:
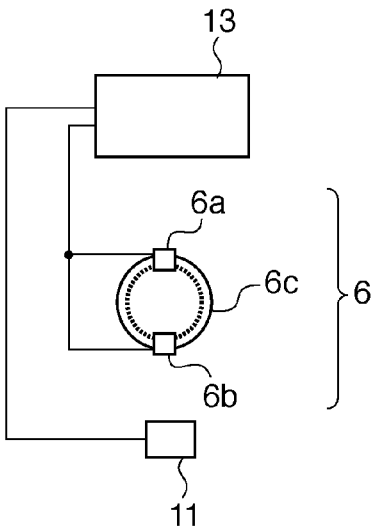

FIGS. 1B and 1C are enlarged views exemplifying the photosensitive drum 5, a rotary encoder 6, and their surroundings in the image forming apparatus according to the first embodiment. FIG. 1B shows the surroundings of the photosensitive drum 5, and FIG. 1C shows those of the rotary encoder 6. Note that FIGS. 1B and 1C are common to all the photosensitive drums 5Y, 5M, 5C, and 5K of the respective colors. In FIG. 1B, the exposure portion 2 is located above the photosensitive drum 5. The exposure portion 2 incorporates an LED head 1 in which LEDs corresponding to about several thousand to 20,000 pixels are aligned in the axial direction of the photosensitive drum 5 (main scanning direction in laser scanner exposure). In the embodiment, the exposure portion 2 exposes the surface of the photosensitive drum 5 using the LED head 1.

The disk-like rotary encoder 6 is arranged on the extension of the driving shaft of the photosensitive drum 5. The rotary encoder 6 is used to detect the rotational speed of the photosensitive drum 5 or a position on the photosensitive drum 5. The transfer position is set at a position shifted by 180° from the exposure position on the photosensitive drum 5. A speed detector 11 at the transfer position is used to detect the speed of surface of the photosensitive drum 5 at the transfer position.

In FIG. 1C, the speed detector 11 directly detects the speed of surface of the photosensitive drum 5 at the transfer position. Based on the calculation results of the rotary encoder 6 and speed detector 11, a speed estimator 13 estimates the speed of surface of the photosensitive drum 5 at the exposure position. Note that a speed detector may be arranged near the exposure position to directly detect a speed of surface at the exposure position.

The rotary encoder 6 includes a disk 6*c* on which grooves or patterns are drawn at the periphery at constant pitches, and two detectors 6*a* and 6*b* for detecting the patterns. The two detectors are arranged near the disk 6*c* because it is difficult to make the disk and the rotating shaft of the photosensitive drum 5 concentric. That is, if only one detector is used, it detects even a speed fluctuation component arising from the eccentricity of the disk and the rotating shaft of the photosensitive drum. To prevent this, the speed fluctuation component is corrected using the two detectors.

The detectors 6*a* and 6*b* are arranged at positions opposite to each other by 180° with respect to the center of the disk 6*c*. By averaging the detection results of the two detectors, the rotational speed of the driving shaft of the photosensitive drum 5 free from the speed fluctuation component generated by the eccentricity is detected. In this manner, the image forming apparatus includes the two speed detectors 6*a* and 6*b* (one of which can be replaced by an estimator), and one speed detector 11 (which can be replaced by an estimator) on the photosensitive drum 5. Note that detection by the speed detector 11 corresponds to processing of obtaining the speed of surface of the photosensitive drum 5 at the transfer position by the second detection unit. Estimation by the speed estimator 13 corresponds to processing of obtaining the speed of surface of the photosensitive drum 5 at the exposure position by the third detection unit. Processing of detecting the rotational speed of the driving shaft of the photosensitive drum 5 using the rotary encoder 6 corresponds to processing by the fourth detection unit.

Figure 2A:
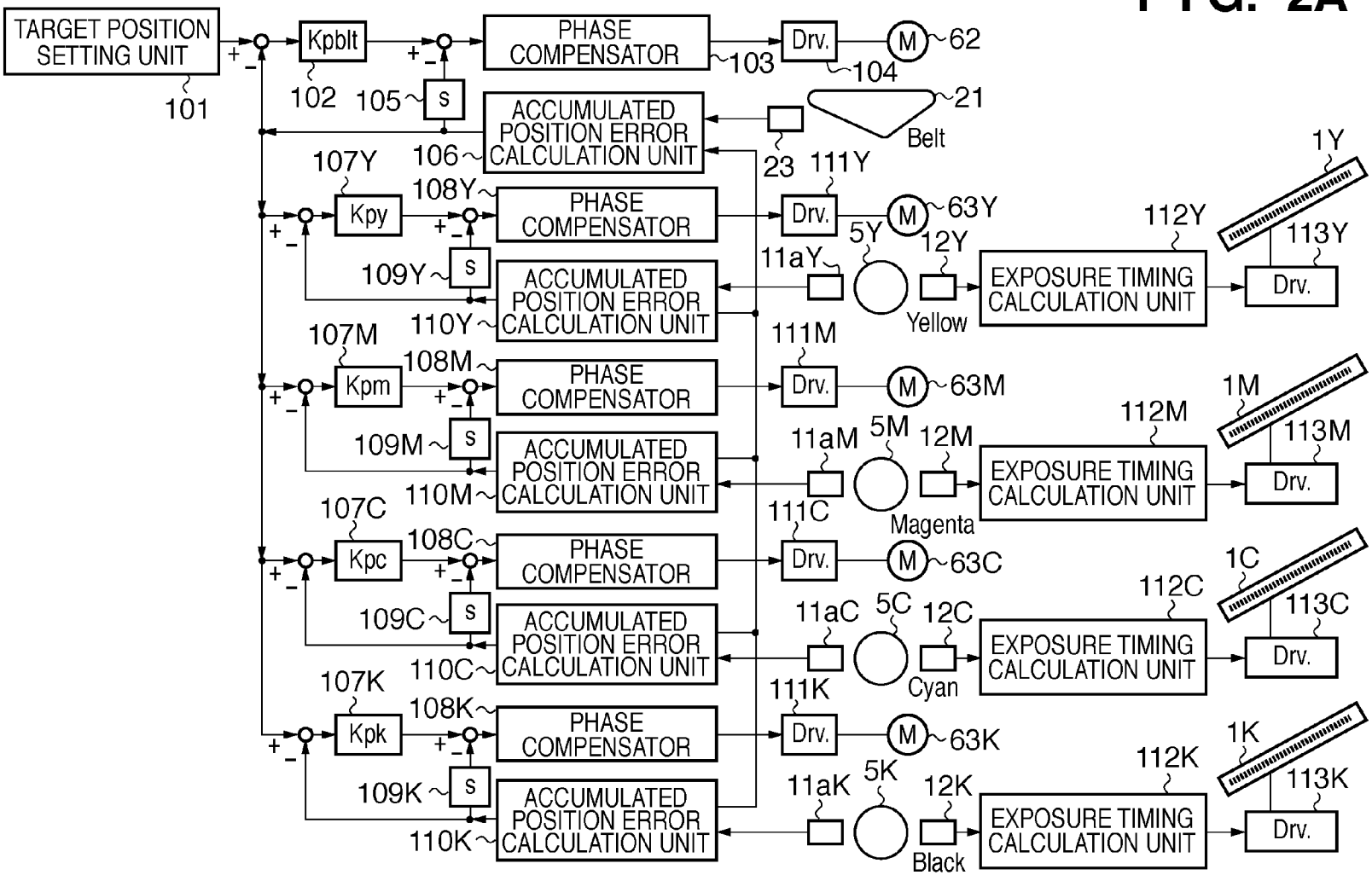
FIGS. 2A and 2B are block diagrams, respectively, exemplifying a block arrangement regarding image forming control, and the block arrangement of control units in the image forming apparatus according to the first embodiment.
Figure 2B:
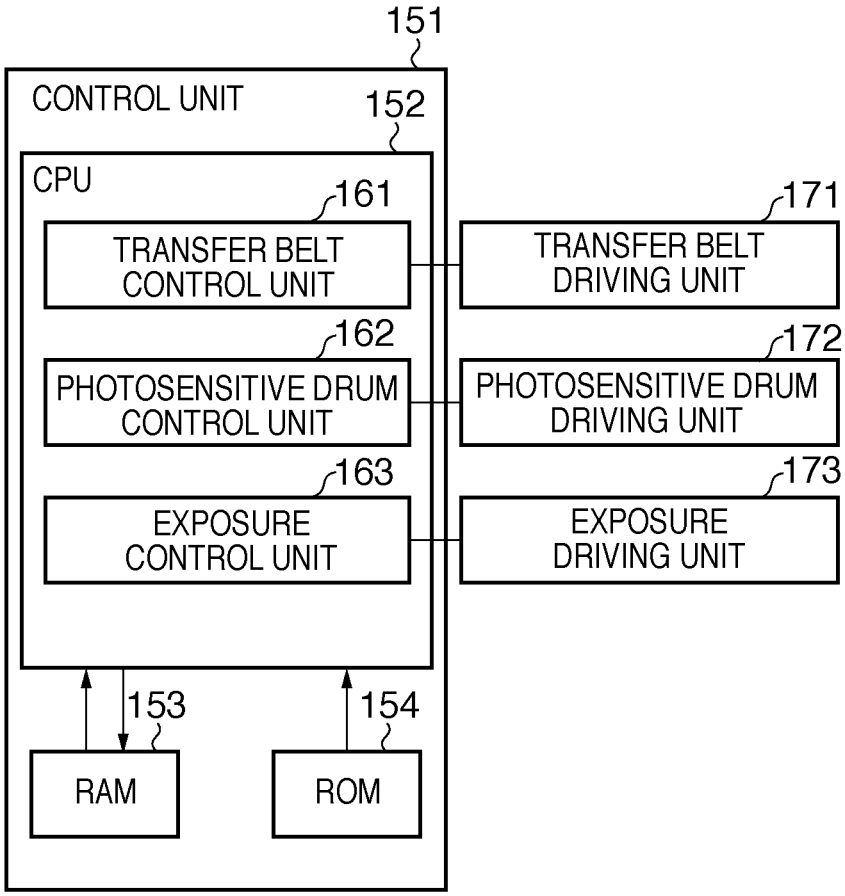

FIG. 2A is a block diagram exemplifying a block arrangement regarding image forming control in the image forming apparatus according to the first embodiment. In particular, FIG. 2A shows a block arrangement regarding driving control of the transfer belt, driving control of the photosensitive drum, and control of the exposure timing according to the first embodiment. FIG. 2B is a block diagram exemplifying the block arrangement of control units in the image forming apparatus according to the first embodiment. Control units for executing driving control of the transfer belt 21, driving control of the photosensitive drum 5, and control of the exposure timing according to the first embodiment will be explained. A control unit 151 includes a CPU 152, RAM (Random Access Memory) 153, and ROM (Read Only Memory) 154. The CPU 152 includes a transfer belt control unit 161, photosensitive drum control unit 162, and exposure control unit 163, which control driving of a transfer belt driving unit 171, photosensitive drum driving unit 172, and exposure driving unit 173, respectively. Note that programs and various data for controlling the image forming apparatus are written in the ROM 154.

In FIG. 2A, a target position setting unit 101, amplifier (Kpblt) 102, phase compensator 103, motor driver 104, and differentiator 105 are blocks regarding driving control of the transfer belt 21, and belong to the transfer belt driving unit 171. An accumulated position error calculation unit 106, amplifiers (Kpy, Kpm, Kpc, and Kpk) 107, phase compensators 108, and differentiators (s) 109 are arranged for the respective colors, are blocks regarding driving control of the photosensitive drums 5Y, 5M, 5C, and 5K, and belong to the photosensitive drum driving unit 172. Accumulated position error calculation units 110 and motor drivers 111 are blocks regarding exposure timing control, and belong to the exposure driving unit 173.

Figure 3:
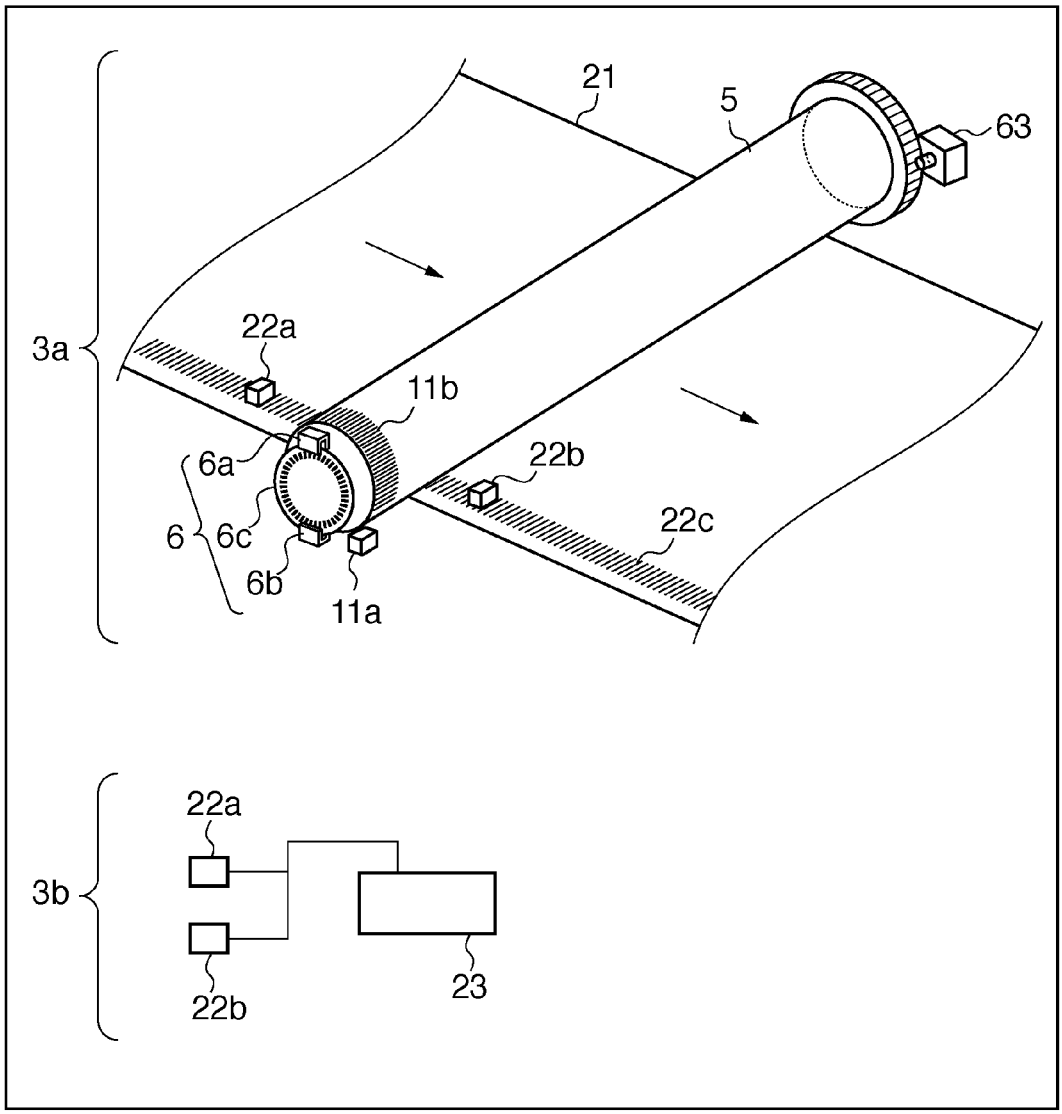
FIG. 3 is a view exemplifying the arrangement of speed detectors near the photosensitive drum 5 in the image forming apparatus according to the first embodiment.

FIG. 3 is a view exemplifying the arrangement of speed detectors near the photosensitive drum 5 in the image forming apparatus according to the first embodiment. As shown in 3*a* of FIG. 3, encoders 22*c* for the transfer belt 21 are set at equal intervals at the end of the surface of the transfer belt 21. Two speed detectors 22*a* and 22*b* (first and second speed sensors) are arranged before and after the photosensitive drum 5 to read the encoders 22*c*. As shown in 3*b* of FIG. 3, a speed estimator 23 is connected to the speed detectors 22*a* and 22*b*. The speed estimator estimates the speed by averaging the results of detection by the two speed detectors in order to increase the speed measurement precision at the position of the transfer portion. This estimation may adopt a function instead of averaging. Note that a speed detector may be arranged at the transfer position to directly detect the speed of surface of the transfer belt 21 at the transfer position, in place of the speed estimator 23. Estimation by the speed estimator 23 and detection by the speed detector arranged at the transfer position correspond to processing of obtaining the speed of surface of the transfer belt 21 at the transfer position by the first detection unit.

As shown in 3*a* of FIG. 3, encoders 11*b* are set at equal intervals at the end of the surface of the photosensitive drum 5. A speed detector 11*a* is arranged near the encoders 11*b* to read them. Note that the first embodiment assumes that the speed detectors 22*a* and 22*b* for the transfer belt 21 are arranged near the yellow photosensitive drum 5Y, as shown in FIG. 1A. However, the speed detectors 22*a* and 22*b* may be arranged near one of the remaining photosensitive drums 5M, 5C, and 5K.

<Sequence of Overall Control According to First Embodiment>

Figure 4:
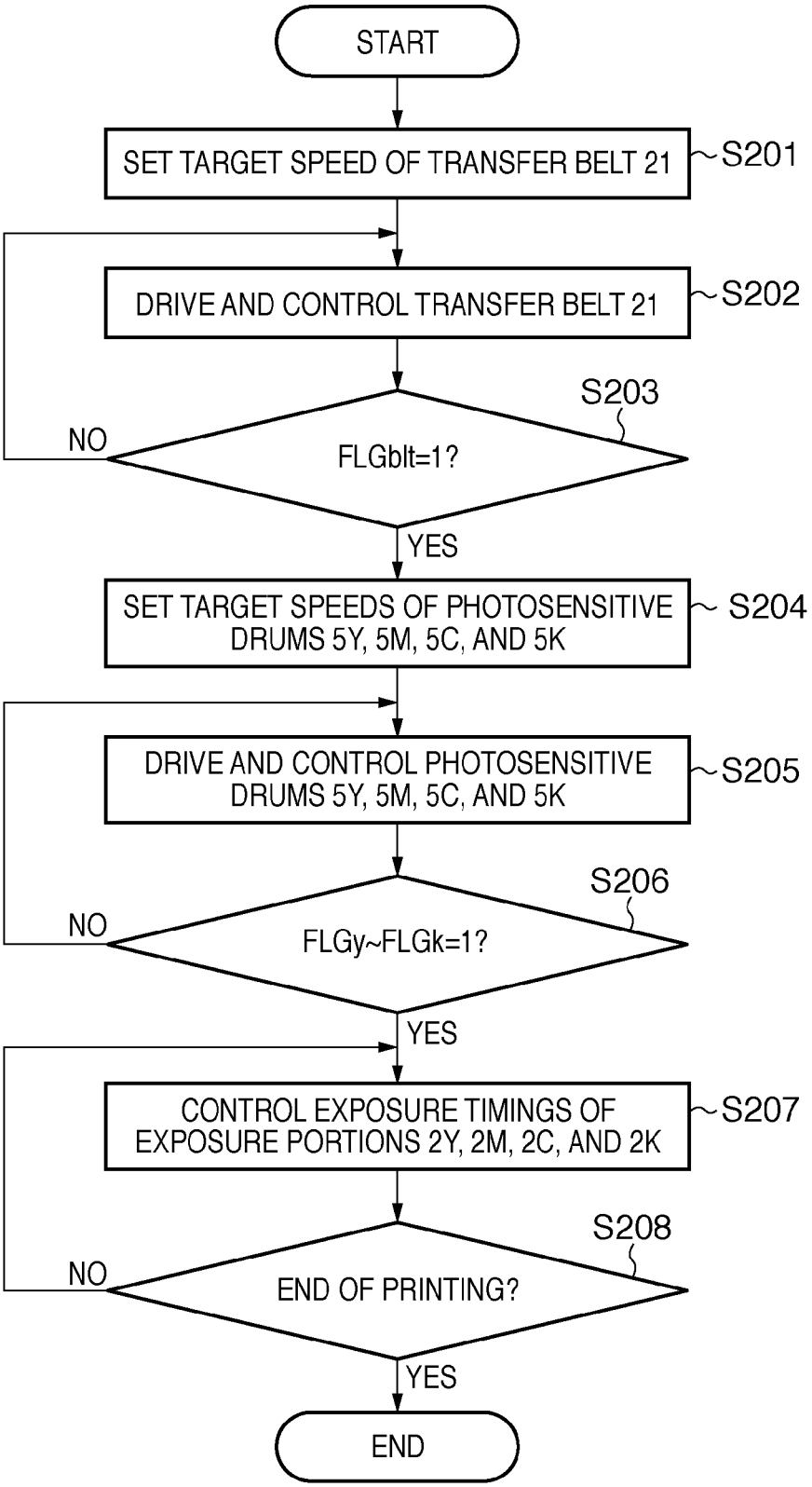
FIG. 4 is a flowchart showing overall processing procedures regarding control according to the first embodiment.

The sequence of overall control concerning image forming processing including driving control of the transfer belt, driving control of the photosensitive drum, and control of the exposure timing in the image forming apparatus according to the first embodiment will be explained. FIG. 4 is a flowchart showing overall processing procedures regarding control according to the first embodiment.

Figure 5A:
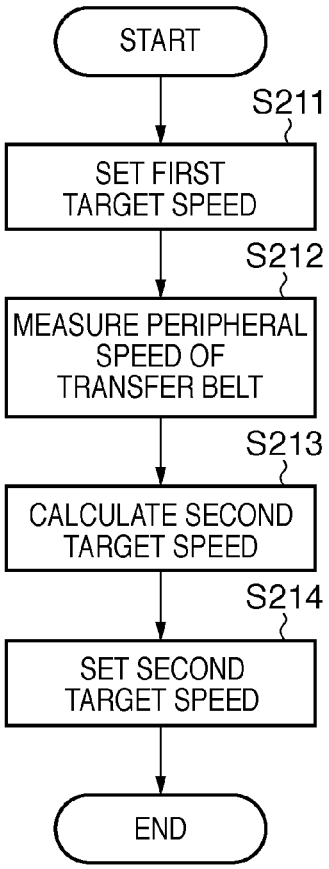
FIGS. 5A and 5B are flowcharts, respectively, showing the procedures of setting the target value of the speed of surface of a transfer belt 21, and those of driving and controlling the transfer belt 21 according to the first embodiment.

In S201, the transfer belt control unit 161 sets a target speed for the speed of surface of the transfer belt 21 in accordance with procedures in FIG. 5A. In S202, the transfer belt control unit 161 drives and controls the transfer belt 21 using the target speed set in S201 as a target value in accordance with procedures in FIG. 5B. In this control, the transfer belt control unit 161 sets "0" or "1" in a flag FLGblt based on the control result. If the flag is "0" in S203, the transfer belt control unit 161 returns to S202 to continue driving control of the transfer belt 21. If the flag is "1", the process shifts to S204. Note that the processes in S201 to S203 correspond to those by the first control unit.

Figure 6A:
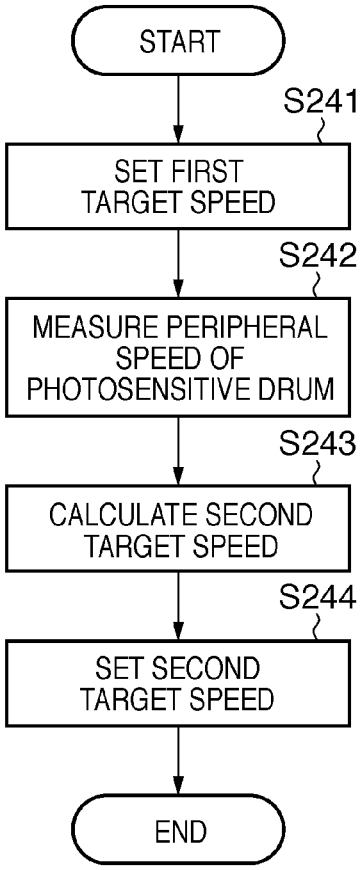
FIGS. 6A and 6B are flowcharts, respectively, showing the procedures of setting the target value of the speed of surface of a photosensitive drum 5Y, and those of driving and controlling the photosensitive drum 5Y according to the first embodiment.

In S204, the photosensitive drum control unit 162 sets a target speed for the speed of surface of each of the photosensitive drums 5Y, 5M, 5C, and 5K at the transfer position in accordance with procedures in FIG. 6A. In S205, the photosensitive drum control unit 162 drives and controls each of the photosensitive drums 5Y, 5M, 5C, and 5K using the target speed set in S204 as a target value in accordance with procedures in FIG. 6B. In this control, the photosensitive drum control unit 162 sets "0" or "1" in flags FLGy, FLGm, FLGc, and FLGk based on the control results. If one of the flags is "0" in S206, the photosensitive drum control unit 162 returns to S205 to continue driving control of a photosensitive drum corresponding to the flag whose value is "0". If the values of all the flags are "1", the process shifts to S207. Note that the processes in S204 to S206 correspond to those by the second control unit.

Figure 7:
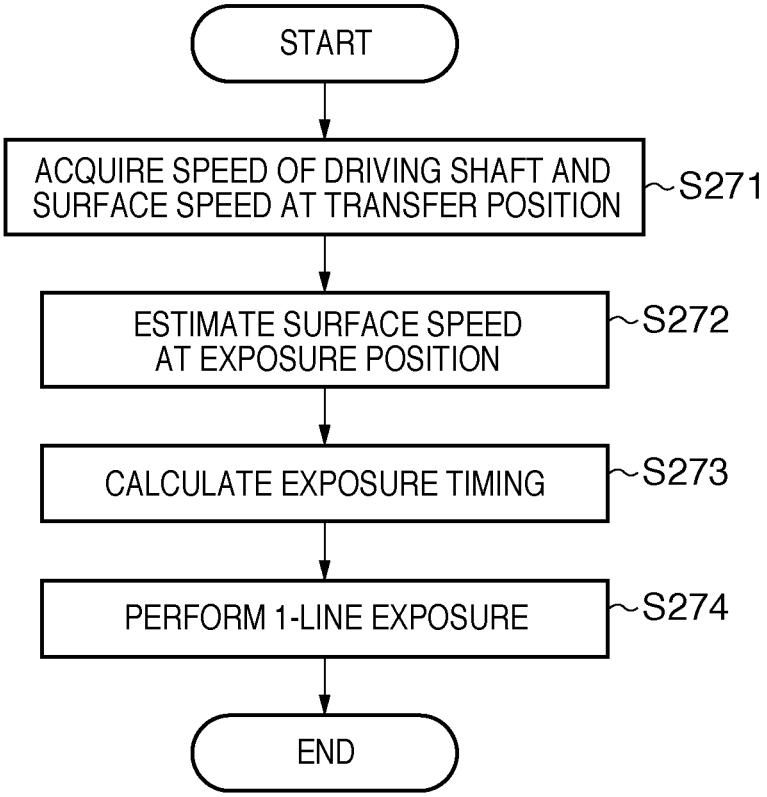
FIG. 7 is a flowchart showing the procedures of controlling the exposure timing according to the first embodiment.

In S207, the exposure control unit 163 controls the exposure timings of the exposure portions 2Y, 2M, 2C, and 2K in accordance with procedures in FIG. 7, executing exposure processing for the photosensitive drums 5Y, 5M, 5C, and 5K. As will be described later, the exposure control unit 163 executes this control based on the speed of surface of each of the photosensitive drums 5Y, 5M, 5C, and 5K at the exposure position. In S208, the exposure control unit 163 determines whether to end printing based on image data. If the exposure control unit 163 determines not to end the print operation, the process returns to S207 to continue control of the exposure timing and exposure processing. If the exposure control unit 163 determines to end the print operation, a series of processes end. Note that the processes in S207 and S208 correspond to those by the third control unit.

<Driving Control of Transfer Belt>

The transfer belt control unit 161 controls the transfer belt driving unit 171 serving as a driving device for the transfer belt 21 so that the speed of surface at the transfer position becomes a predetermined target speed and the transfer belt 21 is driven at a constant speed. Under the control by the transfer belt control unit 161, the target position setting unit 101 sets a target position based on the target speed for driving the transfer belt 21 at a constant speed. For example, when the process speed ps (mm/sec) is set as a target speed and the transfer belt 21 is driven at the same speed as the target speed, a target position x is calculated as the integral value of the process speed:

$$x=\int(ps)dt=(ps)\cdot t$$

That is, the target position x increases linearly with time. To easily handle the numerical value, the target position setting unit 101 adopts an accumulated position error as an actually used target position x'. The target position x' is given as a value obtained by subtracting the time integral of the target speed (ps in this case) from x:

$$x'=x-ps\cdot t=0$$

In other words, the transfer belt 21 is driven so that an output from the accumulated position error calculation unit 106 becomes the target value x' (=0).

Figure 18:
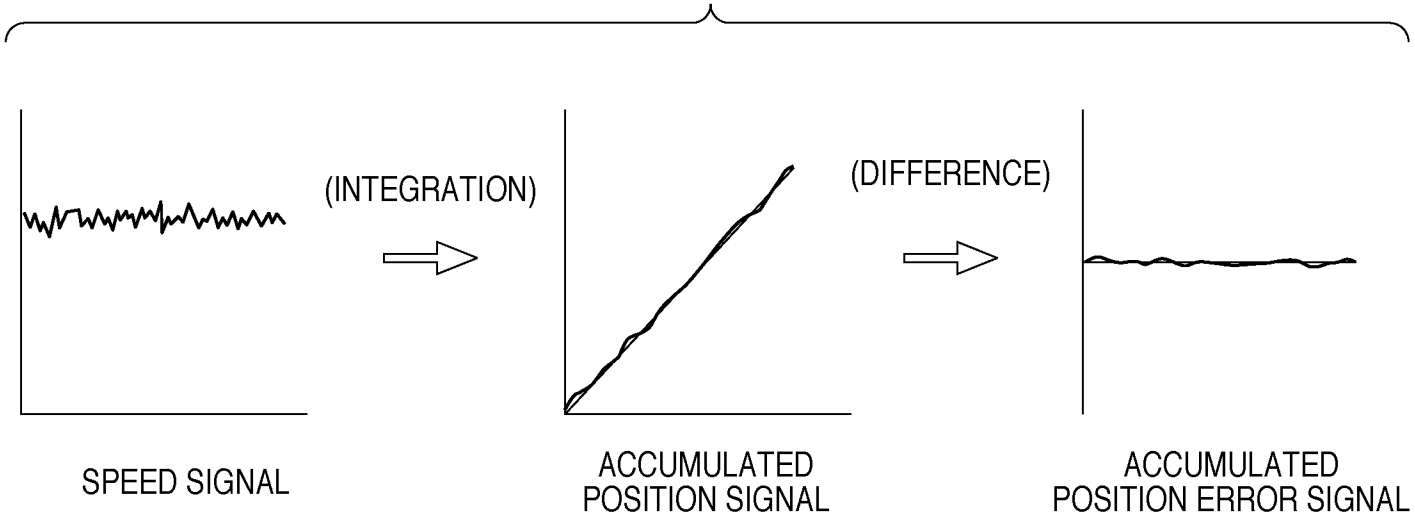
FIG. 18 is a graph showing the relationship between a speed signal and an accumulated position error signal according to the first embodiment.

FIG. 18 is a graph showing the relationship between a speed signal and an accumulated position error signal according to the first embodiment. The speed signal contains measurement noise, so an accumulated position error signal serving as a difference between the integral value of the speed signal and the integral value of the average of the speed signal is calculated. Processing based on the accumulated position error signal can implement more precise control.

When the transfer belt 21 is driven at a predetermined speed, the estimator 23 estimates the speed of surface of the transfer belt 21 at the transfer position based on the result of reading encoder information held on the surface of the transfer belt 21 by the speed detectors 22*a* and 22*b*. Note that the speed estimator 23 may be a position detector (estimator) which outputs a position on the transfer belt 21.

The accumulated position error calculation unit 106 for the transfer belt 21 calculates an accumulated position by integrating the estimation result of the speed of surface of the transfer belt 21. Also, the accumulated position error calculation unit 106 calculates the accumulated position error of the transfer belt 21 by subtracting the time integral value of the target speed from the calculated integral value. The differentiator 105 receives the accumulated position error and outputs the time variation of the accumulated position error. The differentiator 105 calculates the difference between the accumulated position error and the target value "0", and the amplifier (Kpblt) 102 amplifies the difference value. The phase compensator 103 for the transfer belt 21 receives the difference value between a value output from the amplifier 102 and that output from the differentiator 105.

The phase compensator 103 is a phase filter such as a PI (Proportional Integrator) compensator, and provides a desired loop characteristic while stably maintaining the control loop. An output from the phase compensator 103 is input to the transfer belt motor driver 104. Based on the input, the motor driver 104 drives a transfer belt motor 62. The motor driver 104 drives the transfer belt motor 62 so that the speed of surface of the transfer belt 21 comes close to a predetermined target value. More specifically, the motor driver 104 increases the driving speed of the transfer belt motor 62 when the speed of surface is lower than the target value, and decreases it when the speed of surface is higher than the target value.

If this loop functions normally, the transfer belt motor 62 drives the transfer belt 21 at a predetermined speed so that the accumulated position error becomes 0. Since the position control loop of the transfer belt 21 contains a speed minor loop including the differentiator 105, this improves control responseness and enhances the resistance to fluctuations such as disturbance.

(Target Speed Setting Procedures)

FIG. 5A is a flowchart showing the procedures of setting the target value of the speed of surface of the transfer belt 21 according to the first embodiment. The first embodiment aims at reducing the error between the speed of surface of the transfer belt 21 and that of the photosensitive drum 5 at the transfer position to be almost 0. For this purpose, the measurement precisions of the speed detectors for the transfer belt 21 and photosensitive drum 5 need to be increased. In FIG. 5A, therefore, the speed of surface of the transfer belt 21 is set in two steps in order to improve the precision of control of the speed of surface of the transfer belt 21. The first embodiment employs a method of compensating for a difference in absolute detection precision by the two-step settings. Note that the target speed may be set in one step as usual by increasing the precision of the speed detector, encoder, or the like.

In S211, the transfer belt control unit 161 sets the first target speed. This step is a coarse adjustment step of setting the target speed to drive the transfer belt 21 at a predetermined process speed ps. Thereafter, the process shifts to S212.

In S212, the transfer belt control unit 161 measures the speed of surface (peripheral speed at a predetermined position) of the transfer belt 21. In S213, the transfer belt control unit 161 calculates the second target speed. Based on the calculated value, the transfer belt control unit 161 sets the second target speed in S214. S212 to S214 are a fine adjustment step of finely adjusting the target speed based on the circumference (length of one round) of the transfer belt 21 that is known in advance, the time taken for the transfer belt 21 to rotate one round, and the like.

In the processes of S212 to S214, a final target speed vb' is calculated based on a circumference Lb of the transfer belt 21, a set speed Vg, a time tb taken for the transfer belt 21 to rotate one round, and a set first target speed vtb:

$$Lb=vb'\cdot t0b=vtb\cdot tb$$

$$t0b=Lb/Vg$$

From this, $$vb'=vtb\cdot Lb/Vg\cdot tb$$

That is, the transfer belt control unit 161 calculates the difference between the set speed Vg and an actual speed, based on the time taken for the transfer belt 21 to rotate one round. The transfer belt control unit 161 sets the second target speed again so that the actual speed coincides with the set speed. Note that the difference between the set speed and an actual speed arises from thickness nonuniformity of the transfer belt 21, the radial error of the driving roller, and the like. In the above-described way, the target speed can be finely adjusted based on the known circumference of the transfer belt 21, and the speed of surface of one round that is measured using an index signal or the like.

(Driving Control Procedures of Transfer Belt 21)

Figure 5B:
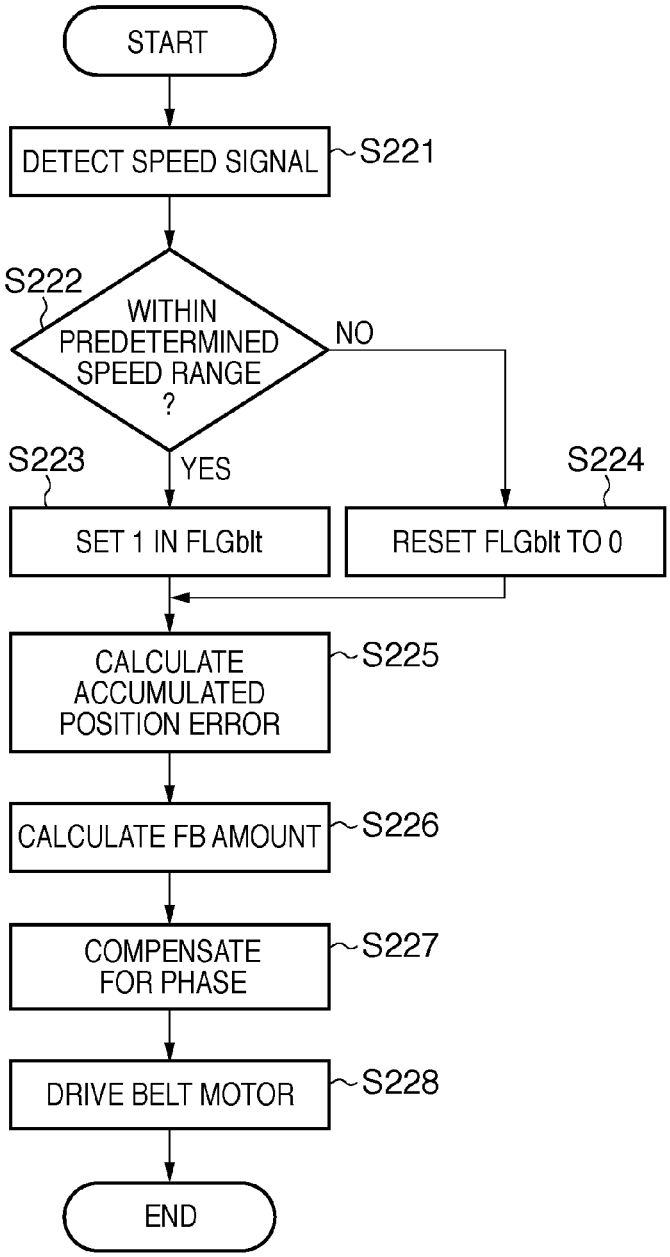

After the transfer belt control unit 161 sets the target speed of the transfer belt 21 based on the processing in FIG. 5A, it shifts to driving control of the transfer belt 21. FIG. 5B is a flowchart showing the procedures of driving and controlling the transfer belt 21 according to the first embodiment. FIG. 5B shows a series of processes executed by the transfer belt control unit 161 in every sample time when the transfer belt control unit 161 performs the speed control by digital sampling control. In this case, digital sampling control is used because it is highly compatible with calculation of the accumulated position error, but another control method is also available. Note that the transfer belt control unit 161 achieves this processing using, for example, interrupt processing in order to execute this processing at the same time as another processing.

In digital sampling control, the transfer belt control unit 161 starts controlling the speed of surface of the transfer belt 21 by an interrupt which occurs in every sampling time at a predetermined interval. In S221, the transfer belt control unit 161 detects a speed signal at the transfer position of the transfer belt 21. At this time, the transfer belt control unit 161 uses the result of estimation by the speed estimator 23 as a speed signal. The process then shifts to S222.

In S222, the transfer belt control unit 161 determines whether the detected speed falls within a predetermined range. If the speed falls within a predetermined range, the transfer belt control unit 161 shifts to step S223 to set "1" in a flag FLGblt. If the speed falls outside the predetermined range, the transfer belt control unit 161 shifts to step S224 to set "0" in the flag FLGblt. After the process in S223 or S224, the process shifts to S225. This flag is used to determine whether to shift to control of the speed of surface of the photosensitive drum 5 in S203 of FIG. 4.

In S225, the transfer belt control unit 161 calculates an accumulated position error using the accumulated position error calculation unit 106. The accumulated position error is obtained by subtracting the product of the average speed and time of the transfer belt 21 from the integral value of the speed of surface at the transfer position of the transfer belt 21. Since the speed of surface fluctuates owing to thickness nonuniformity of the transfer belt 21, the calculation processing desirably uses an average speed obtained by averaging the speed of the transfer belt 21 through one round. After the process in S225, the process shifts to S226.

In S226, the transfer belt control unit 161 calculates an FB (Feed Back) amount to be input to the phase compensator 103. The transfer belt control unit 161 calculates the FB amount by subtracting the output of the error amplifier (Kpblt) 102 from that of the differentiator 105. The FB amount contains the magnitude of an error from the target speed and the direction (positive or negative) of the error. In S227, the transfer belt control unit 161 controls the phase compensator 103 to implement a desired loop characteristic while stably maintaining the control loop. In addition, the phase compensator 103 outputs the FB amount to the motor driver 104. Thereafter, the process shifts to S228.

In S228, the transfer belt control unit 161 controls the motor driver 104 to drive and control the transfer belt motor 62 based on the FB amount. For example, when the direction of the error is positive, this means that the speed of surface is lower than the target speed, so the motor driver 104 increases the driving speed of the transfer belt motor 62. If the direction is negative, this means that the speed of surface is higher than the target speed, and the motor driver 104 decreases the driving speed of the transfer belt motor 62. The FB amount corresponds to the difference between the target speed and the speed of surface. Thus, the motor driver 104 adjusts the variation of the driving speed of the transfer belt motor 62 in accordance with the FB amount.

In this fashion, the transfer belt 21 is controlled to make its speed of surface close to a predetermined target speed while suppressing the accumulated error. As a result, the transfer belt 21 operates at a speed as constant as possible. After that, the process shifts to driving control of the photosensitive drum 5 in S204 and subsequent steps of FIG. 4.

<Driving Control of Photosensitive Drum 5>

Control of the speed of surface of the photosensitive drum 5 will be explained by exemplifying the yellow photosensitive drum 5Y. Note that the speeds of surface of the photosensitive drums 5M, 5C, and 5K corresponding to the remaining colors are also controlled by the same processing.

The photosensitive drum control unit 162 controls the photosensitive drum driving unit 172 serving as a driving device for the photosensitive drum 5Y so that the speed difference between the speed of surface of the transfer belt 21 and that of the photosensitive drum 5 at the transfer position becomes 0. As a target position for this purpose, an output value d' from the accumulated position error calculation unit 106 for the transfer belt 21 is used. The speed of surface of the photosensitive drum 5Y is controlled by controlling a position on the outer surface of the photosensitive drum 5Y based on the operation of the transfer belt 21 at the transfer position. The transfer belt 21 is driven to reduce the accumulated position error to be 0. The accumulated position error calculation unit 106 outputs a value d' which is suppressed to almost a fraction of the loop gain of the accumulated position error in an open loop. The photosensitive drum 5Y is controlled for the accumulated position error d'. When d' takes a value regarded as almost 0, the target value may be set to 0, similar to the transfer belt 21.

When the photosensitive drum 5Y is driven at a predetermined speed, the speed detector 11*a*Y reads encoder information held on the surface of the photosensitive drum 5Y, and outputs the speed of surface of the photosensitive drum 5Y at the transfer position. The accumulated position error calculation unit 110Y for the photosensitive drum 5Y calculates an accumulated position by integrating the speed of surface of the photosensitive drum 5Y. Also, the accumulated position error calculation unit 110Y calculates the accumulated position error of the photosensitive drum 5Y by subtracting the time integral of the target speed from the integral value. The differentiator 109Y receives the accumulated position error and outputs the time variation of the accumulated position error. The differentiator 109Y calculates the difference between the accumulated position error and the target value d', and the error amplifier (Kpy) 107Y amplifies the difference value. The phase compensator 108Y receives the difference value between a value output from the error amplifier 107Y and that output from the differentiator 109Y.

The phase compensator 108Y has the same function as that of the phase compensator 103 for the transfer belt 21. An output from the phase compensator 108Y is input to the motor driver 111Y for the photosensitive drum 5Y. Based on the input, the photosensitive drum control unit 162 controls the motor driver 111Y to drive a photosensitive drum motor 63Y. The motor driver 111Y drives the photosensitive drum motor 63Y by the same control as that of the motor driver 104 for the transfer belt 21 so that the speed of surface of the photosensitive drum 5Y at the transfer position comes close to a predetermined target value. More specifically, the motor driver 111Y increases the driving speed of the photosensitive drum motor 63Y when the speed of surface is lower than the target value, and decreases it when the speed of surface is higher than the target value.

When the transfer belt 21 moves at a speed as constant as possible, the relative speed difference between the speed of surface of the photosensitive drum 5Y and that of the transfer belt 21 at the transfer position becomes almost 0. Even the photosensitive drums 5M, 5C, and 5K corresponding to the remaining colors are controlled so that their speeds of surface at the transfer positions close to the same speed as the speed of surface of the transfer belt 21.

(Operating State of Photosensitive Drum 5)

Figure 19A:
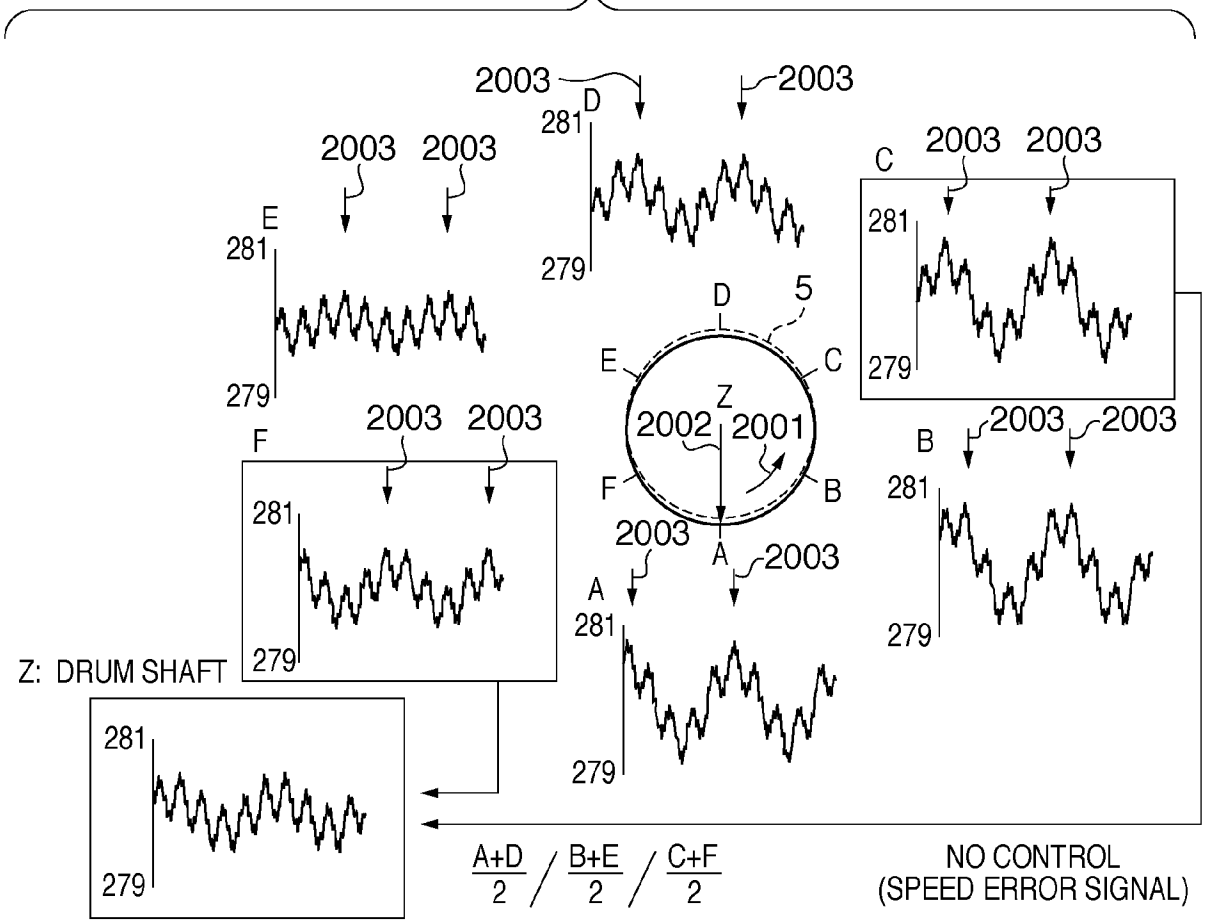
FIGS. 19A and 19B are views exemplifying fluctuations of the speed of surface of the photosensitive drum 5Y and those of the rotational speed of the driving shaft when the rotational speed of the driving shaft is not controlled and when fluctuations of the rotational speed of the driving shaft are suppressed, respectively.

A case in which the photosensitive drum control unit 162 does not control the rotational speed of the driving shaft of the photosensitive drum 5Y will be explained as the first comparative example. FIG. 19A is a view exemplifying fluctuations of the speed of surface of the photosensitive drum 5Y and those of the rotational speed of the driving shaft when the rotational speed of the driving shaft is not controlled. Each waveform in FIG. 19A represents a speed signal. A circle at the center of FIG. 19A represents the photosensitive drum 5 when observed on a section perpendicular to the rotating shaft. A broken line indicates the position of the photosensitive drum 5 at rest, and a solid line indicates a position during rotation.

Each waveform in FIG. 19A is obtained by observing fluctuations of the speed of surface of the photosensitive drum 5 with the lapse of time when the rotational speed of a driving shaft Z of the photosensitive drum 5Y fluctuates. Waveforms at positions A to F are waveforms output from respective detectors when speed detectors (speed sensors) are arranged at observation positions each shifted by a phase of 60° on the outer surface of the photosensitive drum 5. A waveform at position Z indicates the detection result of the rotational speed of the driving shaft of the photosensitive drum 5.

As shown in FIG. 19A, the photosensitive drum 5 generally rotates in a direction indicated by an arrow 2001 while containing an eccentric component generated by misalignment of the central axis and driving shaft. It is known that even when the photosensitive drum 5 is assembled into a printer with high precision, an eccentric component of several ten μm remains in a general product.

An arrow 2002 represents the phase of the eccentric component and indicates a position where the distance from the center of the driving shaft to the surface of the photosensitive drum 5 becomes maximum. When the driving shaft of the photosensitive drum 5 rotates at an angular velocity ω, let r be the distance from the center of the driving shaft to the surface of the photosensitive drum 5. Then, a peripheral speed v of the surface of the photosensitive drum 5 is given by $v=\omega \cdot r$. Under the influence of eccentricity, the speed of surface becomes highest at the position indicated by the arrow 2002 where the distance r is maximum, and lowest at the position where the phase shifts by 180°.

An arrow 2003 for each waveform in FIG. 19A indicates the time when the phase indicated by the arrow 2002 passes each observation position on the surface of the photosensitive drum 5. As is apparent from FIG. 19A, the speed of surface becomes highest at the timings when the phase indicated by the arrow 2002 passes respective positions B to F. At position E, the speed fluctuation width becomes minimum. This is because speed fluctuations through one round of the photosensitive drum 5 and those caused by the eccentricity cancel each other at position E at the rotational frequency of the driving shaft of the photosensitive drum 5. In contrast, the speed fluctuation width becomes maximum at position B shifted in phase by 180° from position E. As for the accumulated position error, it is apparent that fluctuations are small at position E and large at position B, similar to FIG. 19A, though the phase delays by 90° from the speed signal waveform in FIG. 19A.

Figure 19B:
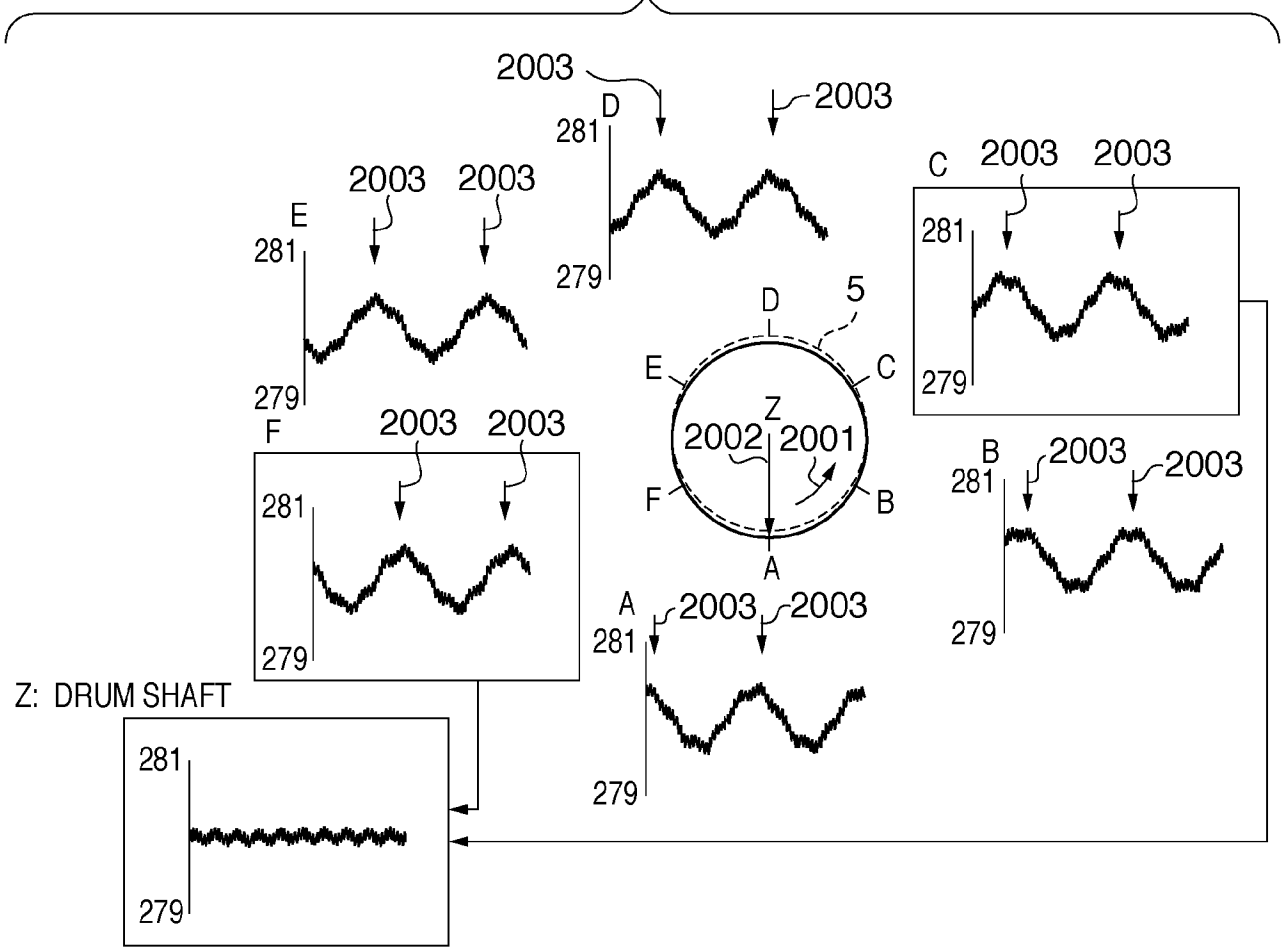

To the contrary, a case in which the photosensitive drum control unit 162 suppresses fluctuations of the rotational speed of the driving shaft of the photosensitive drum 5Y will be explained as the second comparative example. FIG. 19B is a view exemplifying fluctuations of the speed of surface of the photosensitive drum 5Y and those of the rotational speed of the driving shaft when control is done to suppress fluctuations of the rotational speed of the driving shaft. Each waveform in FIG. 19B represents a speed signal. Compared to FIG. 19A, speed fluctuations caused by a plurality of frequency components owing to the eccentricity of a gear and the like are satisfactorily suppressed in the waveform of the driving shaft Z in FIG. 19B. Similarly, it is revealed that even an accumulated position error corresponding to the speed signal of the driving shaft Z is suppressed sufficiently.

As is apparent from FIG. 19B, when the photosensitive drum 5Y has an eccentric component, the speed of surface fluctuates regardless of the position on the outer surface of the photosensitive drum 5Y even if fluctuations of the rotational speed of the driving shaft Z are suppressed. If no ideal slip transfer system can be implemented, some kind of measure is required to suppress a registration error generated by this phenomenon.

Figure 20:
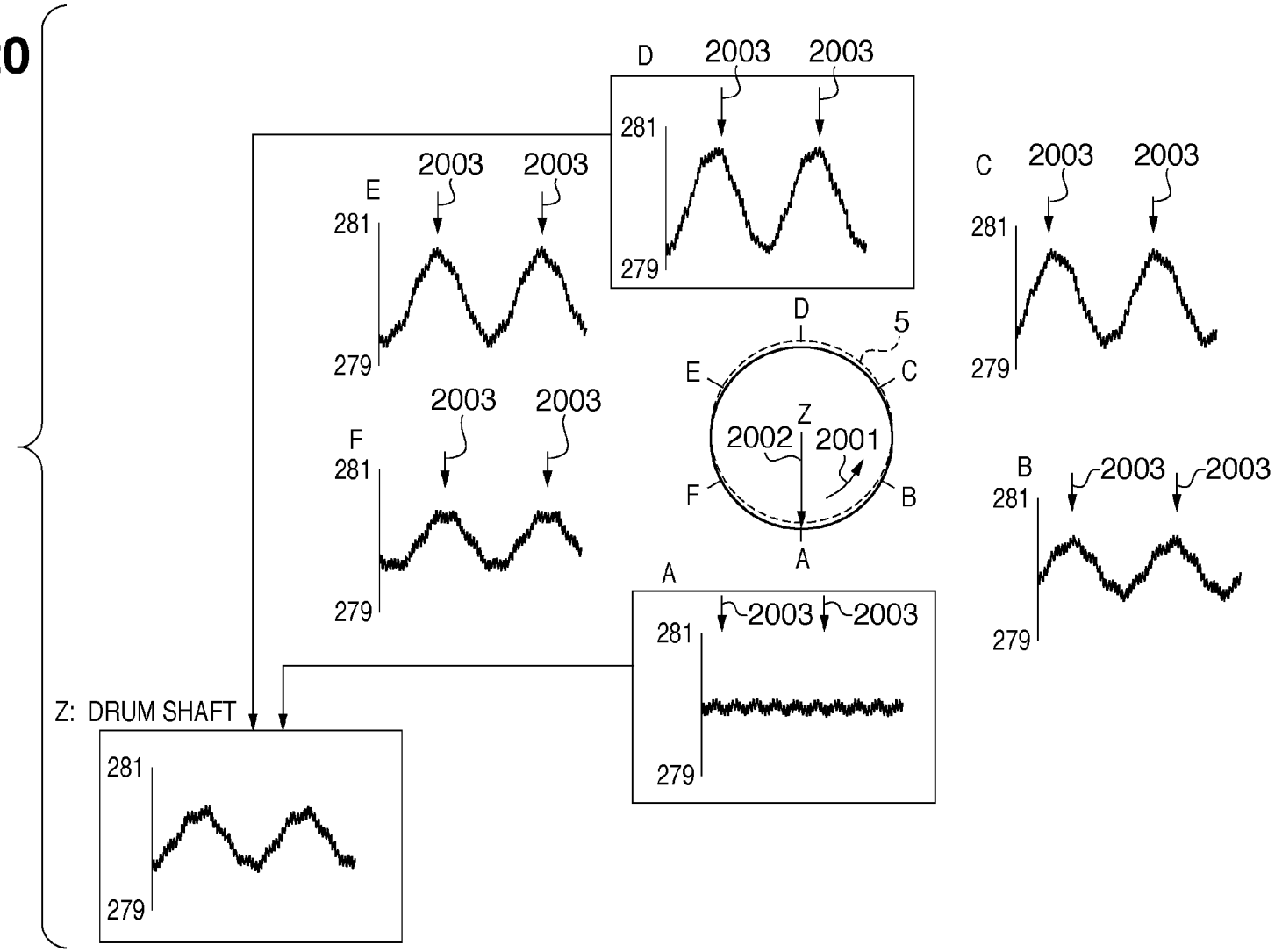
FIG. 20 is a view exemplifying fluctuations of the speed of surface of the photosensitive drum 5Y and those of the rotational speed of the driving shaft according to the first embodiment.

In the first embodiment, the photosensitive drum control unit 162 controls driving of the photosensitive drum 5Y so that the speed of surface of the photosensitive drum 5Y at the transfer position becomes equal to that of the transfer belt 21. FIG. 20 is a view exemplifying fluctuations of the speed of surface of the photosensitive drum 5Y and those of the rotational speed of the driving shaft according to the first embodiment. Each waveform in FIG. 20 represents a speed signal. In the first embodiment, the photosensitive drum control unit 162 controls the speed of surface of the photosensitive drum 5Y at transfer position A to be almost equal to that of the transfer belt 21 at transfer position A, instead of suppressing fluctuations of the rotational speed of the driving shaft Z, unlike the second comparative example. By this control, fluctuations of the speed of surface of the photosensitive drum 5Y at transfer position A are suppressed, as shown in FIG. 20. Even an accumulated position error corresponding to the speed signal is similarly suppressed at transfer position A.

This control reduces a stick-slip between the photosensitive drum 5Y and the transfer belt 21, and a toner image on the photosensitive drum 5Y is directly transferred onto the transfer belt 21. As is apparent from FIG. 20, when control is performed to suppress fluctuations of the speed of surface arising from the eccentric component of the photosensitive drum 5Y at transfer position A, fluctuations with an amplitude double as large as the eccentric component (driving shaft Z) appear in the speed of surface at position D having a phase difference of 180° from position A.

Figure 6B:
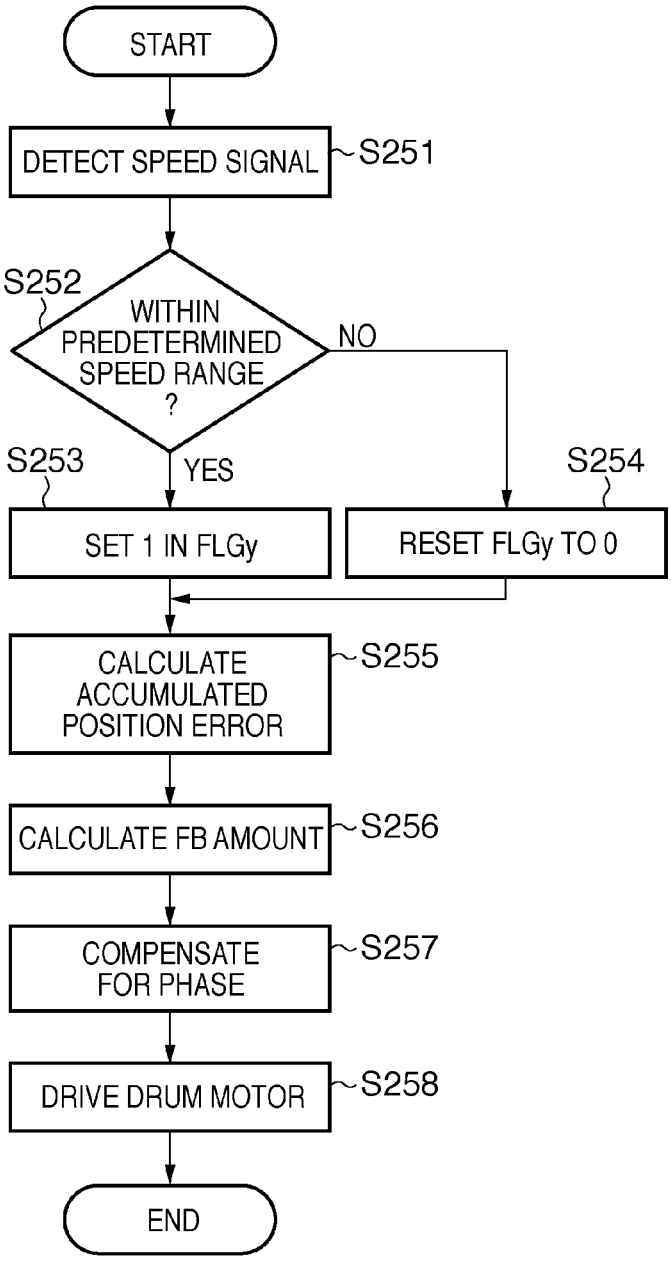

FIG. 6A is a flowchart showing the procedures of setting the target value of the speed of surface of the photosensitive drum 5Y according to the first embodiment. FIG. 6B is a flowchart showing the procedures of driving and controlling the photosensitive drum 5Y according to the first embodiment. In FIG. 6A, the photosensitive drum control unit 162 sets the speed of surface of the transfer belt 21 as the first target speed of the speed of surface of the photosensitive drum 5Y so that the speed of surface of the photosensitive drum 5Y comes close to the same speed as that of the transfer belt 21. In this case, the procedures of setting the target value of the speed of surface of the photosensitive drum 5Y, and those of driving and controlling the photosensitive drum 5Y based on the target value are the same as those of control by the transfer belt control unit 161, and a description thereof will not be repeated. Note that S241 to S244 in FIG. 6A correspond to S211 to S214 in FIG. 5A, and S251 to S258 in FIG. 6B correspond to S221 to S228 in FIG. 5B.

By this processing, the speed of surface of the photosensitive drum 5Y at the transfer position falls within a predetermined range, and "1" is set in the flag FLGy. In addition, the speed of surface becomes constant while suppressing the accumulated position error. As for the photosensitive drums 5M, 5C, and 5K corresponding to the remaining colors, "1" is set in the flags FLGm, FLGc, and FLGk by the same control, and the speeds of surface at the transfer positions become constant within a predetermined range. After that, the process shifts to control of the exposure timing in S207 and subsequent steps in FIG. 4.

<Control of Exposure Timing>

Control of the exposure timing at the exposure portion 2 will be explained by exemplifying the yellow exposure portion 2Y. The operations of the exposure portions 2M, 2C, and 2K corresponding to the remaining colors are also controlled by the same processing.

The exposure control unit 163 controls the exposure driving unit 173 serving as a driving device for the exposure portion 2Y to expose the photosensitive drum 5Y at constant intervals in the sub-scanning direction. In FIG. 2A, a speed detector 12Y detects the speed of surface of the photosensitive drum 5Y at the exposure position. An exposure timing calculation unit 112Y calculates the exposure timing in accordance with the detection result of the speed of surface. More specifically, the exposure timing calculation unit 112Y calculates timing information for advancing the exposure timing when the speed of surface of the photosensitive drum 5Y at the exposure position increases, and delaying it when the speed of surface decreases. An LED driver 113Y is a driving unit which causes the LED head 1Y to emit light. Based on the calculated value, the LED driver 113Y drives the LED head 1Y so that the exposure interval in the sub-scanning direction on the photosensitive drum 5Y comes close to a constant interval.

The speed of surface of the photosensitive drum 5Y at the exposure position is detected as follows. For example, as shown in FIG. 2A, the speed of surface can be directly detected by arranging the speed detector 12Y near the exposure position. If the speed detector 12Y cannot be arranged near the exposure position, the speed estimator 13Y may estimate the speed, as shown in FIG. 1C. In this case, the speed estimator 13Y estimates the speed of surface at the exposure position based on the result of detecting the rotational speed of the photosensitive drum 5Y by the speed detectors 6*a* and 6*b* of the rotary encoder 6Y (result of detection by the fourth detection unit), and the result of detection by the speed detector 11Y at the transfer position of the photosensitive drum 5 (result of detection by the second detection unit). In FIG. 19A, a relation $\Delta Z=(\Delta A+\Delta D)/2=(\Delta B+\Delta E)/2=(\Delta C+\Delta F)/2$ holds from the observation of the relationship between the fluctuation components ΔA to ΔF of waveforms A to F and the fluctuation component ΔZ of the waveform of the driving shaft Z. Based on this relation, for example, a speed signal at exposure position D can be calculated from a speed signal at transfer position A and a speed signal for the driving shaft Z:

$$\Delta D=2\cdot\Delta Z-\Delta A$$

Note that this relation is applied to even a method of canceling the eccentric component by averaging signals output from detectors arranged at positions opposite to each other by 180° in the rotary encoder or the like. Processing by the speed detector 12Y or speed estimator 13Y corresponds to that by the third detection unit.

The exposure timing calculation unit 112Y calculates the exposure timing, that is, LED emission timing using the speed of surface of the photosensitive drum 5Y at the exposure position. More specifically, the exposure timing calculation unit 112Y calculates position information by integrating the speed information by the time. Based on the position information, the exposure timing calculation unit 112Y calculates the timing to expose the surface of the photosensitive drum 5Y at a predetermined interval. The predetermined interval is, for example, 42.3 μm for 600 dpi and 21.16 μm for 1,200 dpi. The LED driver 113Y drives the LED head 1Y to expose the surface of the photosensitive drum 5Y at an exposure timing calculated by the exposure timing calculation unit 112Y. The surface of the photosensitive drum 5Y is then exposed in, for example, every 42.3 μm for 600 dpi and every 21.16 μm for 1,200 dpi.

FIG. 7 is a flowchart showing the procedures of controlling the exposure timing according to the first embodiment. In S271, the exposure control unit 163 acquires the rotational speed of the driving shaft of the photosensitive drum 5Y and the speed of surface at the transfer position, as described above. In S272, the exposure control unit 163 controls the speed estimator 13Y to estimate the speed of surface of the photosensitive drum 5Y at the exposure position, based on the acquisition results. The speed estimator 13Y executes the estimation processing using $\Delta D=2\cdot\Delta Z-\Delta A$. Thereafter, the process shifts to S273.

In S273, the exposure control unit 163 controls the exposure timing calculation unit 112Y to calculate the exposure timing using the speed of surface of the photosensitive drum 5Y at the exposure position. The exposure timing calculation unit 112Y outputs the calculation result to the LED driver 113Y. In S274, the exposure control unit 163 controls the LED driver 113Y to drive the LED head 1Y and execute 1-line exposure in the main scanning direction. Then, the interrupt processing ends, ending the process in S207 of FIG. 4. The exposure timings for the remaining colors are also controlled in the same manner. Unless the print operation ends in S208 of FIG. 4, the process returns to S207 to repetitively execute a series of exposure processes in FIG. 7.

As described above, the image forming apparatus according to the first embodiment controls driving of the transfer belt so that the speed of surface of the transfer belt at the transfer position comes close to a constant speed. In addition, the image forming apparatus controls driving of the photosensitive drum so that the error between the speed of surface of the photosensitive drum and that of the transfer belt at the transfer position becomes almost 0. Further, the image forming apparatus controls the exposure timing in accordance with fluctuations of the speed of surface at the exposure position so that the exposure interval in the sub-scanning direction on the photosensitive drum comes close to a constant interval. This can minimize generation of an unpredictable random stick-slip which arises from the error of the speeds of surface between the photosensitive drum and the transfer belt at the transfer position under the influence of the eccentric component of the photosensitive drum. Toner images formed at constant intervals on the photosensitive drum can be transferred onto the transfer belt in the sub-scanning direction without any position error. The image forming apparatus can therefore suppress the AC color registration error and form a high-quality image without any color misregistration.

In the first embodiment, each speed detector has the same meaning as that of a position detector, and control according to the first embodiment can be implemented based on information of either detector. That is, position information can be easily acquired by integrating speed information, and speed information can be easily acquired by differentiating position information. For this reason, the speed detector and position detector are interchangeable. Even if the position detector replaces the speed detector in the embodiment, the same effects as those described above can be attained.

The first embodiment has described an image forming apparatus which intermediately transfers toner images of the respective colors onto the transfer belt. However, the present invention is not limited to this and is also applicable to an image forming apparatus which conveys a print material by the transfer belt and sequentially transfers toners of the respective colors onto the print material.

The first embodiment can suppress the AC component in a position error of each color, and does not consider processing of locking the phases of the photosensitive drums of the respective colors at the transfer positions. However, applying this processing to the first embodiment can further suppress color misregistration.

In the first embodiment, the speed detector is used to detect the speed of surface of the transfer belt at the transfer position, that of the photosensitive drum, and the like. Alternatively, a laser Doppler velocimeter may be used to detect the speeds of surface and the like.

Second Embodiment

The second embodiment of the present invention will be described with reference to FIG. 8. In the image forming apparatus according to the first embodiment, the speed detector 11*a* is arranged below the photosensitive drum 5 to directly detect the speed of surface of the photosensitive drum 5 at the transfer position, as shown in 3*a* of FIG. 3. However, no speed detector may be able to be arranged at this position under the structural limitation of the image forming apparatus or the like. Hence, in the second embodiment, a speed detector is arranged at a position different from the transfer position, and the speeds of surface of a photosensitive drum 5 at the transfer and exposure positions are estimated using the detection result of the speed detector.

Figure 8:
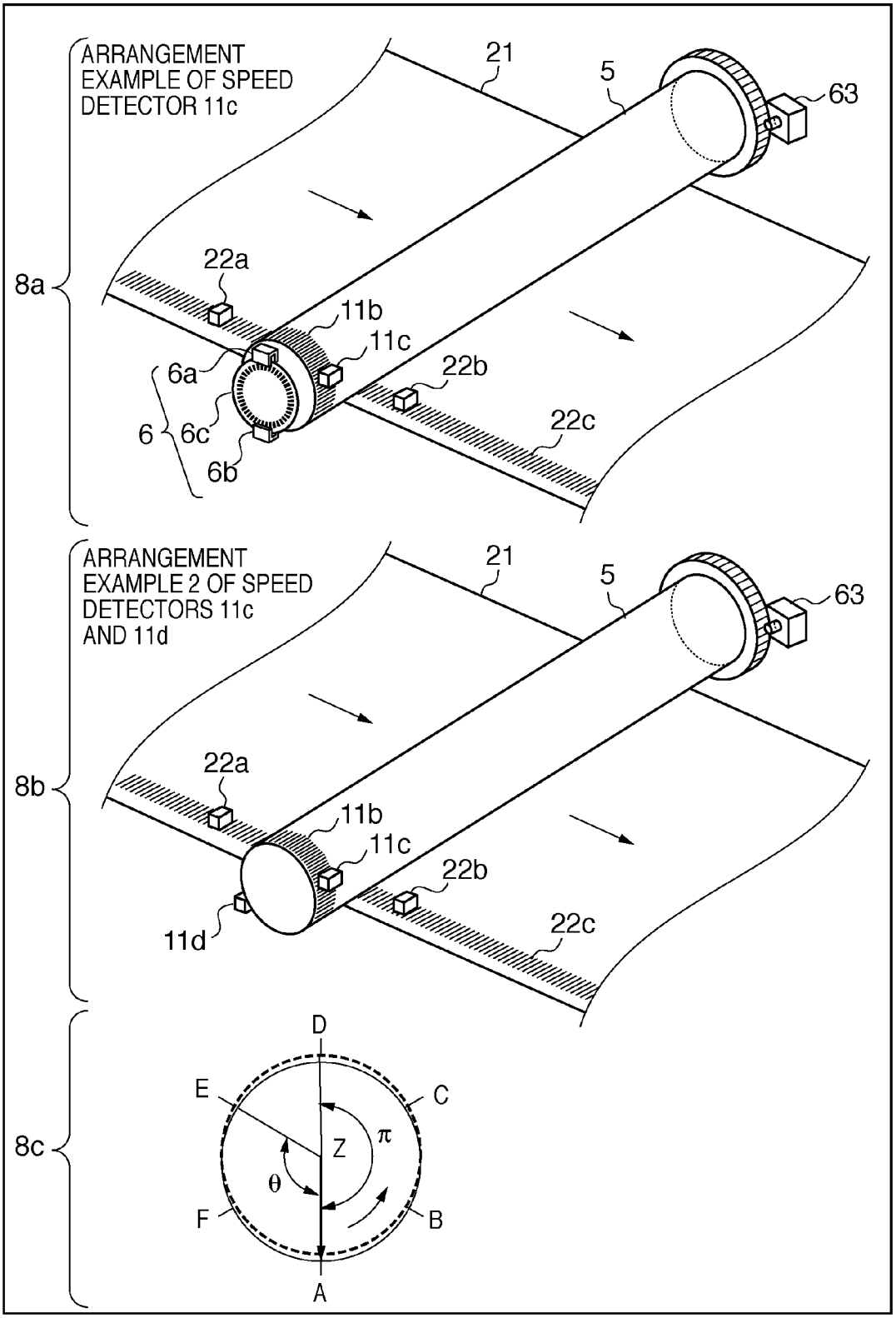
FIG. 8 is a view exemplifying an arrangement of speed detectors near a photosensitive drum 5 in an image forming apparatus according to the second embodiment.

FIG. 8 is a view exemplifying the arrangement of speed detectors near the photosensitive drum 5 in an image forming apparatus according to the second embodiment. For example, 8*a* of FIG. 8 shows a case in which a speed detector 11*c* (third speed sensor) is arranged to detect the speed of surface of the photosensitive drum 5 at a position different from the transfer and exposure positions. 8*b* of FIG. 8 shows a case in which a speed detector 11*d* (fourth speed sensor) is further arranged at a position where it opposes the speed detector 11*c* by 180° on the photosensitive drum 5, instead of arranging the rotary encoder on the shaft of the photosensitive drum 5. A method of estimating the speeds of surface of the photosensitive drum 5 at the transfer and exposure positions will be explained based on the respective arrangement examples of 8*a* and 8*b* of FIG. 8.

8*c* of FIG. 8 is a view showing a method of estimating the speeds of surface of the photosensitive drum 5 at transfer position A and exposure position D, based on the arrangement examples of 8*a* and 8*b* of FIG. 8. In 8*c* of FIG. 8, position A is a transfer position, and position D rotated through 180° (π) from position A is an exposure position. Note that the exposure position may be not position D but another position.

Position E in 8*c* of FIG. 8 corresponds to the position of the speed detector 11*c* in 8*a* of FIG. 8. A rotary encoder 6 and the speed detector 11*c* in 8*a* of FIG. 8 detect the rotational speed ΔZ of the driving shaft Z and the speed of surface ΔE at position E on the photosensitive drum 5 in 8*c* of FIG. 8. Speed fluctuations y caused by the eccentricity of the photosensitive drum 5 at position E are given by calculating the difference between ΔZ and ΔE:

$$y=\Delta E-\Delta Z=Am\cdot\sin(\omega t)$$

where Am is the amplitude of the eccentric component, and ω is the angular velocity of the driving shaft. Letting θ be the phase angle between transfer position A and speed detector E, the phase at transfer position A delays from that at position E by the angle θ along with rotation of the driving shaft of the photosensitive drum 5. Thus, speed fluctuations y' caused by the eccentricity at transfer position A are given by $$y'=Am\cdot\sin(\omega t+\theta)$$

Since $$y'=\Delta A-\Delta E$$

the speed of surface ΔA at transfer position A is calculated by $$\Delta A=\Delta Z+Am\cdot\sin(\omega t+\theta)$$

Similarly, the speed of surface ΔD at exposure position D is calculated by $$\Delta D=\Delta Z+Am\cdot\sin(\Omega t+\theta+\pi)$$

In contrast, positions E and B in 8*c* of FIG. 8 correspond to the positions of the speed detectors 11*c* and 11*d* in 8*b* of FIG. 8. Note that positions B and E are opposite to each other by 180° (π), and θ is the phase angle between transfer position A and speed detector E. Since positions B and E are opposite to each other by 180°, the rotational speed ΔZ of the driving shaft of the photosensitive drum 5 is easily obtained using the results of detecting the speeds of surface ΔB and ΔE at positions B and E by the speed detectors 11*c* and 11*d:*

$$\Delta Z=(\Delta B+\Delta E)/2$$

By averaging the speeds of surface ΔB and ΔE at positions opposite to each other by 180°, the eccentric component is canceled to calculate the rotational speed ΔZ of the driving shaft Z of the photosensitive drum 5. Based on the calculation result of ΔZ, speeds of surface at transfer position A and exposure position D are calculated by the same method as that in 8*a* of FIG. 8:

$$\Delta A=(\Delta B+\Delta E)/2+Am\cdot\sin(\omega t+\theta)$$

$$\Delta D=(\Delta B+\Delta E)/2+Am\cdot\sin(\omega t+\theta+\pi)$$

In the second embodiment, driving control of the photosensitive drum 5 and control of the exposure timing are executed based on the speeds of surface of the photosensitive drum 5 at the transfer and exposure positions that are estimated in the foregoing fashion. The methods of controlling the photosensitive drum 5 and exposure timing are the same as those in the first embodiment, so a description thereof will not be repeated. Driving control of a transfer belt 21 is also the same as that in the first embodiment, and a description thereof will not be repeated.

As described above, the image forming apparatus according to the second embodiment estimates speeds of surface at the transfer and exposure positions based on the result of detection by the speed detector arranged at a position different from the transfer and exposure positions, and the result of detecting the rotational speed of the driving shaft of the photosensitive drum. Even if speeds of surface at the transfer and exposure positions cannot be directly detected, they can be estimated appropriately. The same effects as those in the first embodiment can be obtained.

In the second embodiment, the transfer and exposure positions are opposite to each other by 180° on the photosensitive drum 5, but their positional relationship is not limited to this. For example, even when the transfer and exposure positions are opposite to each other by 150°, 210°, or the like, speeds of surface can be calculated.

Third Embodiment

The third embodiment of the present invention will be described with reference to FIGS. 9 to 12. In the first and second embodiments, the LED head is used as an exposure source. In addition, the exposure timing to perform exposure at a constant interval in the sub-scanning direction is controlled in accordance with the speed of surface of the photosensitive drum 5 at the exposure position. In the third embodiment, an image forming apparatus using a scanner system as an exposure source controls the rotational speed of a scanner motor to make the exposure interval in the sub-scanning direction close to a constant interval. Further, the image forming apparatus properly sets the time period of scanning and the scanning frequency for exposure in the main scanning direction.

Figure 9:
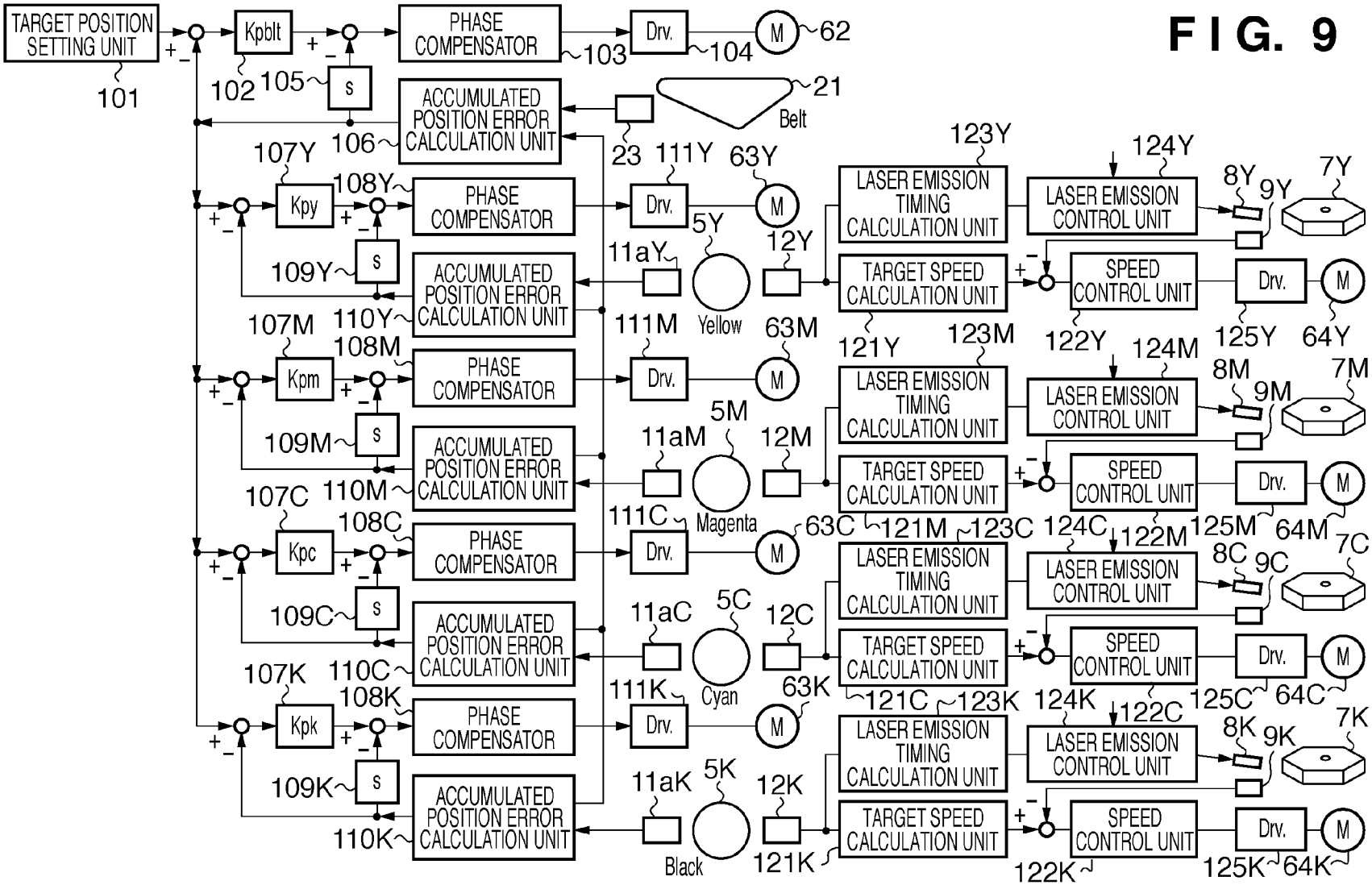
FIG. 9 is a block diagram exemplifying a block arrangement regarding image forming control in an image forming apparatus according to the third embodiment.

FIG. 9 is a block diagram exemplifying a block arrangement regarding image forming control in the image forming apparatus according to the third embodiment. In the third embodiment, driving control of a transfer belt 21 and that of a photosensitive drum 5 are the same as those in the first embodiment, and a description thereof will not be repeated. Although yellow (Y) exposure processing will be explained, the following description also applies to the remaining colors.

In the third embodiment, devices concerning exposure in FIG. 9 operate as follows under the control of an exposure control unit 163. A speed detector 12Y which is arranged at the exposure position for a photosensitive drum 5Y directly detects the speed of surface of the photosensitive drum 5Y at the exposure position. The speed detector 12Y outputs the detection result to a target speed calculation unit 121Y and laser emission timing calculation unit 123Y. When the transfer and exposure positions are opposite to each other by 180° on the photosensitive drum 5, the speed of surface at the exposure position fluctuates in phase with the eccentric component of the photosensitive drum 5Y with an amplitude double as large as the eccentric component, as shown in FIG. 20. By utilizing this characteristic, the speed of surface at the exposure position may be estimated from the eccentric component, instead of using the speed detector 12Y.

The exposure control unit 163 uses the laser emission timing calculation unit 123Y to calculate the laser emission timing (exposure start timing in the main scanning direction) based on an output from the speed detector 12Y. A laser emission control unit 124Y controls a laser 8Y to emit light based on input image data at the calculated emission timing, sequentially executing 1-line exposure in the main scanning direction.

The exposure control unit 163 acquires information about the rotational state of a polygon mirror 7Y based on a BD signal obtained when a beam detect (BD) sensor 9Y detects a laser beam emitted by the laser 8Y outside the image area. When the polygon mirror 7Y is a hexahedral mirror, as shown in FIG. 9, the BD sensor 9Y outputs BD signals six times at every 60° during one round of the polygon mirror. A speed control unit 122Y receives an error signal which is a difference value between a signal output from the target speed calculation unit 121Y and the BD signal. Based on the error signal, the speed control unit 122Y outputs a signal to a scanner motor driver 125Y to drive a scanner motor 64Y. Based on this signal, the scanner motor driver 125Y drives the scanner motor 64Y. Accordingly, the scanner motor 64Y is driven to have a target speed calculated by the target speed calculation unit 121Y. Also, the polygon mirror 7Y is driven.

Figure 10:
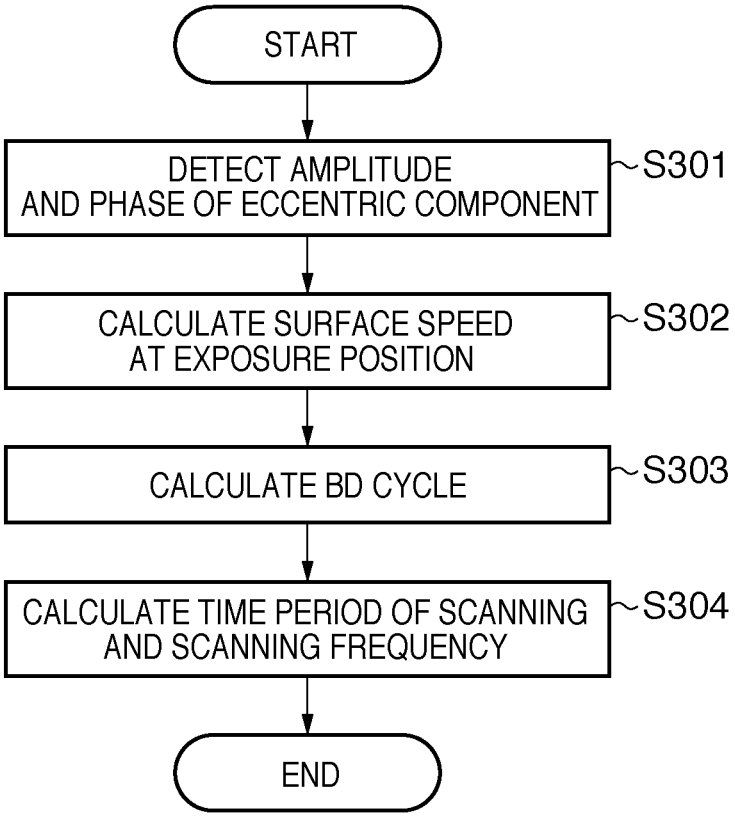
FIG. 10 is a flowchart showing control procedures by an exposure control unit according to the third embodiment.

FIG. 10 is a flowchart showing control procedures by the exposure control unit 163 according to the third embodiment. In S301, the exposure control unit 163 detects the amplitude (eccentric amount) and phase of the eccentric component of the photosensitive drum 5. In S302, the exposure control unit 163 detects the speed of surface of the photosensitive drum 5Y at the exposure position based on the detection result of S301.

Even when the polygon mirror is used to expose the photosensitive drum 5, the exposure control unit 163 needs to perform exposure at a constant interval in the sub-scanning direction. For this purpose, the exposure control unit 163 needs to synchronize the BD cycle (for a hexahedral mirror, the time taken for the hexagonal mirror to rotate a ⅙ round) and the rotation fluctuation amount of the photosensitive drum 5Y with each other by controlling the rotation of the polygon mirror in accordance with fluctuations of the speed of surface of the photosensitive drum 5. For example, when T is the time taken to rotate the photosensitive drum 5Y at the interval (for example, 21.6 μm for 1,200 dpi) of the sub-scanning position at the exposure position of the photosensitive drum 5, the BD cycle also needs to be controlled to be T.

In S303, the exposure control unit 163 uses the target speed calculation unit 121Y to calculate the target value of the rotational speed of the polygon mirror based on the calculation result of S302. As a result, the target value of the BD cycle corresponding to the rotational speed is determined. In S304, the exposure control unit 163 calculates the time period of scanning and the scanning frequency for exposure in the main scanning direction, based on the BD cycle.

Figure 11:
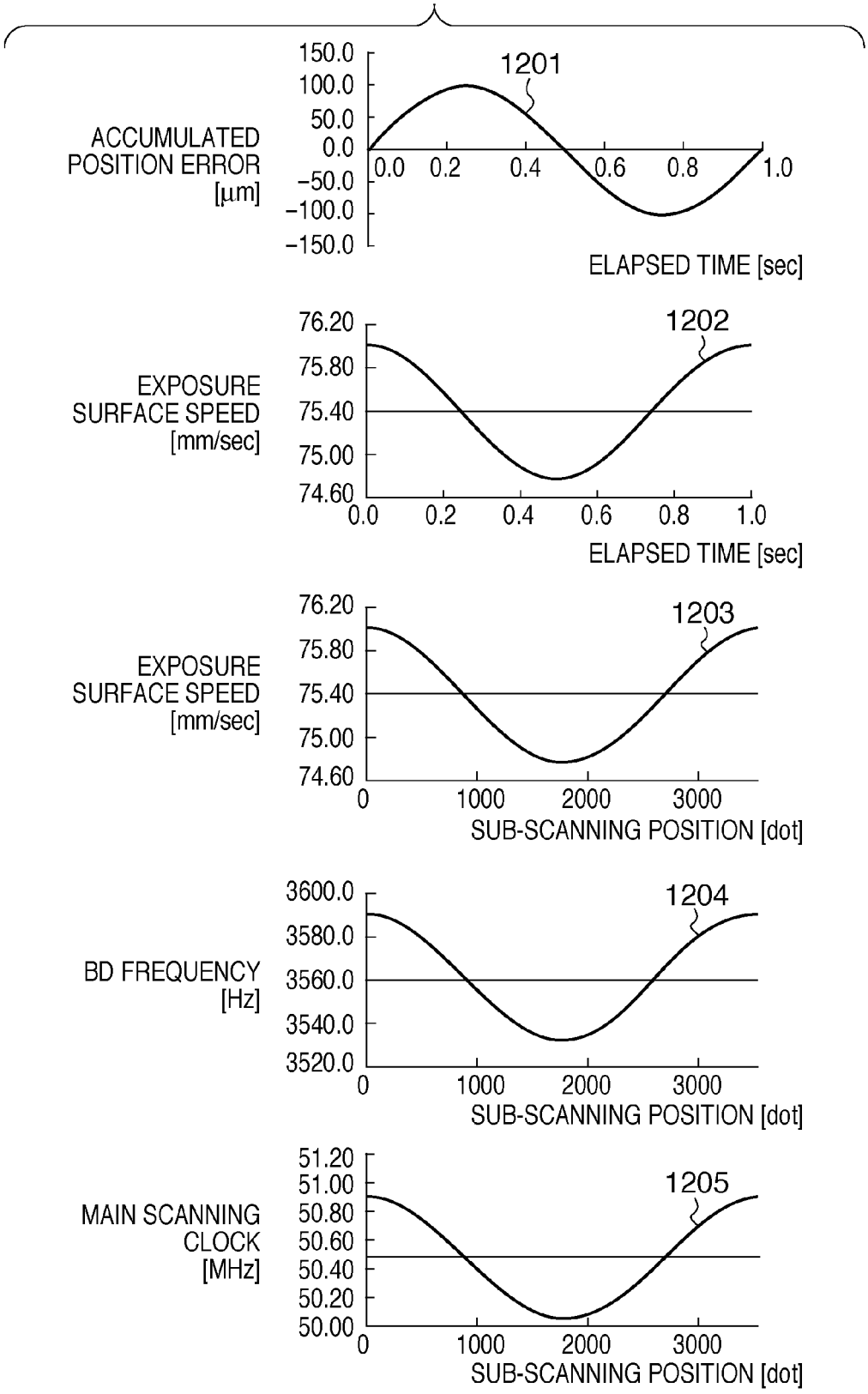
FIG. 11 is a graph showing the waveform of each parameter according to the third embodiment.

With these settings, the exposure control unit 163 controls 1-line exposure processing. The polygon mirror is then driven at a corresponding speed so that the set time period of scanning and the scanning frequency are obtained at the exposure timing. Note that the speed of surface of the photosensitive drum 5Y at the exposure position periodically fluctuates in one cycle which is the time taken for one rotation of the photosensitive drum 5Y, as shown in FIG. 11. Hence, the exposure control unit 163 suffices to determine the exposure start timing in the sub-scanning direction in one cycle, and the time period of scanning and the scanning frequency in the main scanning direction.

FIG. 11 is a graph showing the waveform of each parameter according to the third embodiment. For example, assume that the photosensitive drum 5 has a diameter of 24 mm, an eccentric amount of ±50 μm (range of 100 μm), a process speed of 75.4 (24π) mm, and a sub-scanning pitch of 1,200 dpi, and rotates once per sec. In each graph of FIG. 11, the time range along the abscissa axis corresponds to one cycle of rotation of the photosensitive drum 5. A sub-scanning count per sec (sub-scanning count per round of drum) L is $$L=75.4/25.4*1200=3562.1(\text{scans})$$

When there is no eccentric component, it suffices to start 1-line exposure in every $$T=1/L=280.7(\mu\text{sec})$$

Also, the BD cycle in a steady state suffices to be 280.7 (μsec).

Similar to the first embodiment, the photosensitive drum 5 is controlled so that the speed of surface at the transfer position comes close to the same speed as the speed of surface of the transfer belt 21. When the eccentric amount of the photosensitive drum 5 is ±50 μm (range of 100 μm), fluctuations as double as ±100 μm (range of 200 μm) are observed at the exposure position. Since fluctuations of the speed of surface by the eccentricity are expressed by a sine wave, an accumulated position error Δx is also given by $$\Delta x(\mu\text{m})=100*\sin(\omega t)$$

(1201).

The fluctuation component of the speed of surface at the exposure position is obtained by differentiating Δx by the time:

$$\Delta v(\text{mm/sec})=0.1/\omega*\cos(\omega t)$$

Since the average speed of the speed of surface (speed of exposure surface) v of the photosensitive drum 5 at the exposure position is 75.4 (mm/sec), $$v(\text{mm/sec})=75.4+\Delta v=75.4+0.1/\omega*\cos(\omega t)$$

(1202).

To confirm a change of the speed of exposure surface v with respect to a sub-scanning position (dot), the unit of the abscissa axis is converted based on the fact that the sub-scanning count in the cycle (1 sec) of one round of the photosensitive drum 5 is 3562.1 (scans) (1203).

In the third embodiment, in order to rotate the scanner motor at the same speed as the speed of exposure surface v (1203) corresponding to each sub-scanning position, it suffices to set the BD frequency to a frequency corresponding to the speed. A BD frequency fbd is converted into $$fbd(\text{Hz})=3562.1+k1*\cos(\omega t)$$

(1204).

An allowable time period of scanning in the main scanning direction fluctuates upon fluctuations of the BD frequency. Thus, the exposure control unit 163 changes even the resolution, that is, scanning frequency in the main scanning direction with the scanning time. For a main scanning width of 210 mm and a scanning efficiency of 70%, a scanning frequency (main scanning clock) fclk in the main scanning direction is $$fclk(\text{MHz})=50.9+k2*\cos(\omega t)$$

(1205). FIG. 12 is a table exemplifying numerical values acquired by the above processing.

As described above, the image forming apparatus according to the third embodiment controls the exposure timing to perform exposure at a constant interval in the sub-scanning direction in accordance with the speed of surface of the photosensitive drum at the exposure position when the scanner system is used as an exposure source. More specifically, the image forming apparatus controls the rotational speed of the scanner motor in accordance with the speed of surface to execute exposure so that the exposure interval in the sub-scanning direction comes close to a constant interval. In addition, the image forming apparatus calculates the time period of scanning and the scanning frequency for exposure in the main scanning direction, which are determined in accordance with the speed of surface. Even the image forming apparatus using a scanner system as an exposure source can form electrostatic latent images at constant intervals on the photosensitive drum, and transfer toner images onto the transfer belt in the sub-scanning direction without any position error, similar to the first and second embodiments. Therefore, the image forming apparatus can suppress the AC color registration error and form a high-quality image without any color misregistration.

Also in the third embodiment, as well as the first and second embodiments, the transfer and exposure positions on the photosensitive drum 5 are opposite to each other by 180° for descriptive convenience. However, the positional relationship between the transfer and exposure positions is arbitrary. The third embodiment has described a polygon mirror scanner having a large moment of inertia. However, the image forming apparatus may adopt a MEMS scanner having a smaller moment of inertia.

Fourth Embodiment

The fourth embodiment of the present invention will be described with reference to FIGS. 13 to 17. An image forming apparatus according to the fourth embodiment employs a scanner system which uses a polygon mirror as an exposure source, similar to the third embodiment. By making the rotational speed of the scanner motor close to a constant speed, the image forming apparatus according to the fourth embodiment need not set the time period of scanning and the scanning frequency in the main scanning direction, unlike the third embodiment. Instead, the image forming apparatus according to the fourth embodiment corrects a position error in the sub-scanning direction by image processing for image data.

Figure 13:
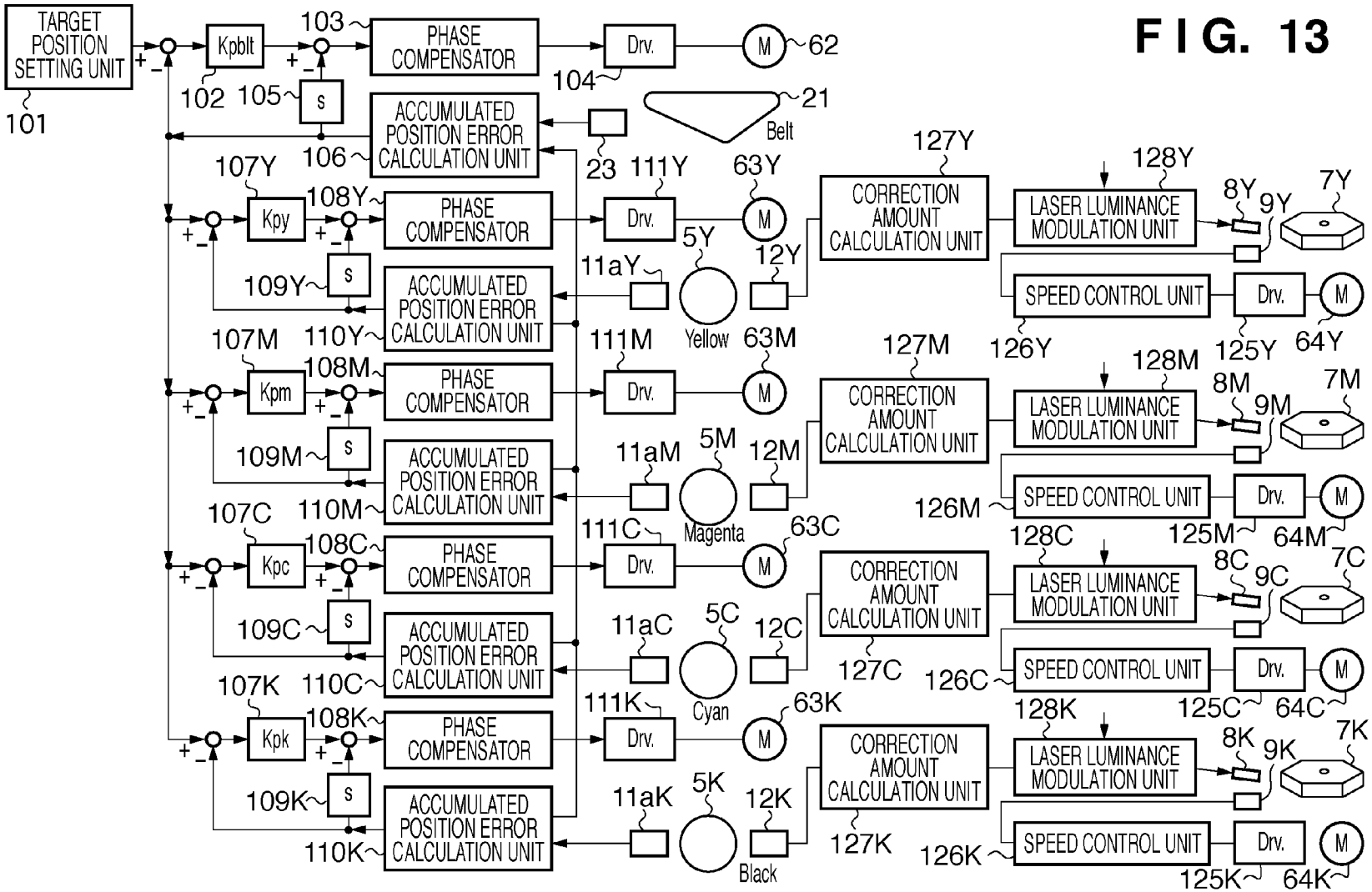
FIG. 13 is a block diagram exemplifying a block arrangement regarding image forming control in an image forming apparatus according to the fourth embodiment.

FIG. 13 is a block diagram exemplifying a block arrangement regarding image forming control in the image forming apparatus according to the fourth embodiment. In the fourth embodiment, driving control of a transfer belt 21 and that of a photosensitive drum 5 are the same as those in the first embodiment, and a description thereof will not be repeated. Although yellow (Y) exposure processing will be explained, the following description also applies to the remaining colors.

In the fourth embodiment, devices concerning exposure in FIG. 13 operate as follows under the control of an exposure control unit 163. A speed detector 12Y which is arranged at the exposure position for a photosensitive drum 5Y directly detects the speed of surface of the photosensitive drum 5Y at the exposure position. The speed detector 12Y outputs the detection result to a correction amount calculation unit 127Y. Similar to the third embodiment, the speed of surface at the exposure position may be estimated based on the eccentric component of the photosensitive drum 5Y, in place of using the speed detector 12Y.

The correction amount calculation unit 127Y detects a position error in the sub-scanning direction based on the speed information, and outputs, to a laser luminance modulation unit 128Y, correction data for correcting the position error. The laser luminance modulation unit 128Y corrects input image data by image processing based on the correction data. Based on the corrected image data, the laser luminance modulation unit 128Y causes a laser 8Y to emit light, exposing the photosensitive drum 5Y.

A speed control unit 126Y acquires scanning position information of the laser beam, based on a signal (BD signal) output from a BD sensor 9Y. The speed control unit 126Y controls a scanner motor driver 125Y by PLL speed control based on the information. The scanner motor driver 125Y operates a polygon mirror 7Y by driving a scanner motor 64Y arranged for the polygon mirror 7Y. In the fourth embodiment, the scanner motor 64Y is controlled to make its rotational speed close to a constant speed.

Figures 15, 16:
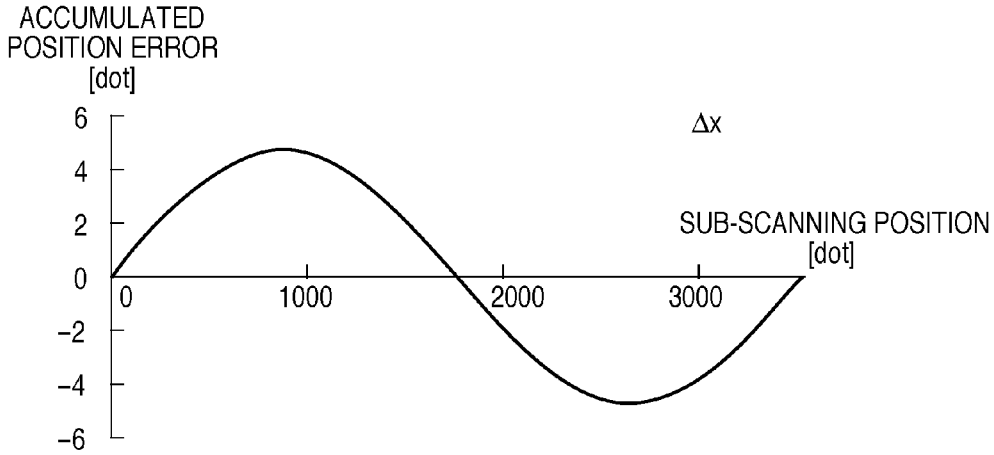
FIG. 15 is a graph exemplifying an accumulated position error according to the fourth embodiment.
FIG. 16 is a table exemplifying numerical values in control by the exposure control unit according to the fourth embodiment.

FIG. 15 is a graph exemplifying an accumulated position error according to the fourth embodiment. Note that the photosensitive drum 5 has the same specifications as those of FIG. 11 in the third embodiment. Fluctuations of the speed of surface by the eccentricity of the photosensitive drum 5 are expressed by a sine wave. Thus, similar to the third embodiment (1201 in FIG. 11), an accumulated position error Δx is also given by $$\Delta x(\mu\text{m})=100*\sin(\omega t)$$

For a sub-scanning pitch of 1,200 dpi, the interval of one dot is about 21.2 μm, and fluctuations with an amplitude (100 μm) of Δx correspond to about 4.7 dots, as shown in FIG. 15. FIG. 16 is a table exemplifying numerical values acquired by the above processing. In the fourth embodiment, the exposure control unit 163 corrects image data used for exposure and the exposure intensity based on fluctuations of Δx. The exposure control unit 163 forms electrostatic latent images on the photosensitive drum 5Y at constant intervals, eliminating a position error caused by fluctuations of the speed of surface of the photosensitive drum 5Y. The correction method will be explained with reference to FIG. 17.

Figure 17:
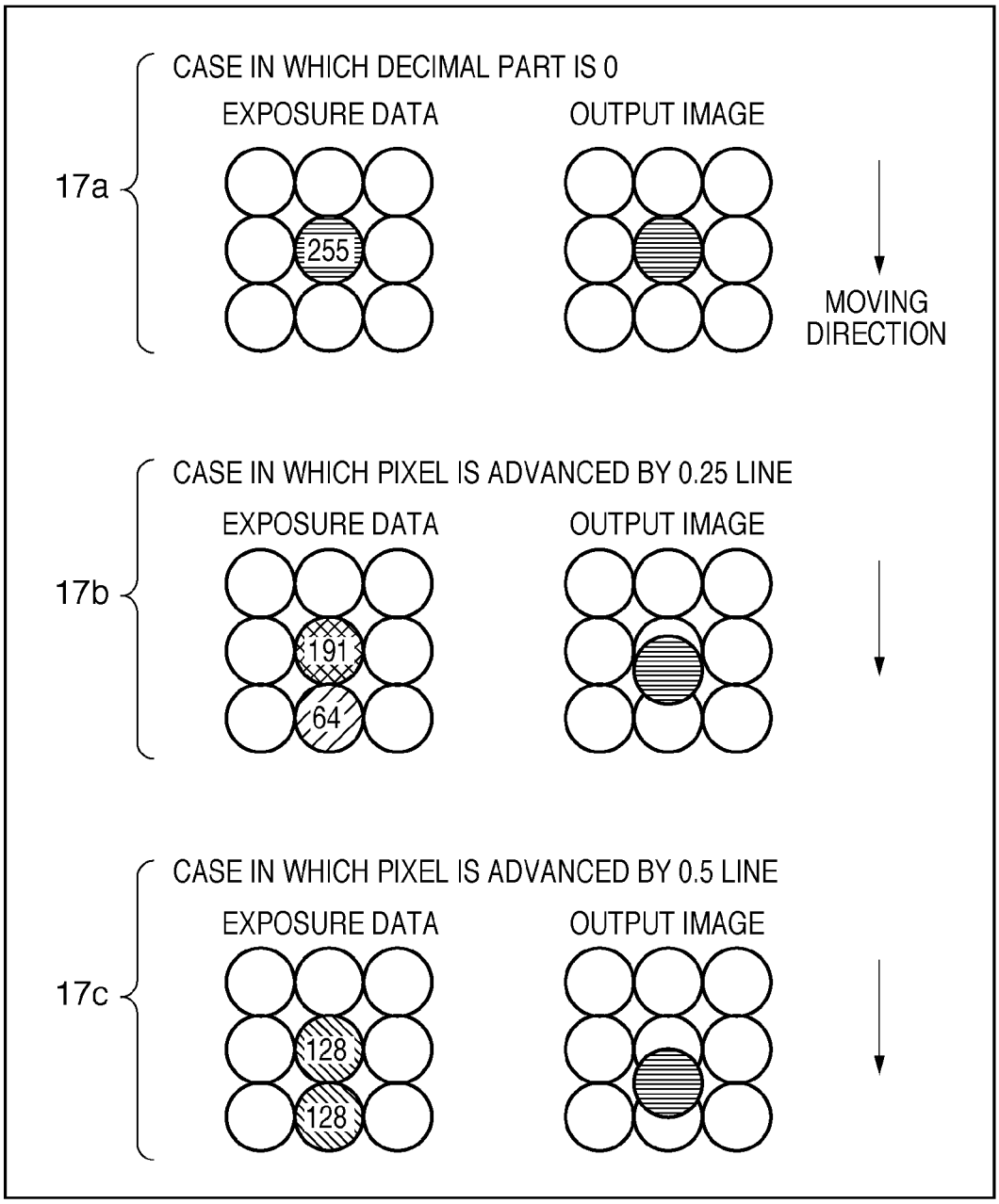
FIG. 17 is a view showing the concept of correcting the exposure intensity of image data according to the fourth embodiment.

FIG. 17 is a view showing the concept of correcting the exposure intensity of image data according to the fourth embodiment. 17*a* of FIG. 17 shows a case in which the value of the decimal part is 0. 17*b* and 17*c* of FIG. 17 show a case in which the decimal part is not 0. In 17*a*, 17*b* and 17*c* of FIG. 17, the exposure intensity is represented by 256 tone levels. In the fourth embodiment, the exposure control unit 163 controls the correction amount calculation unit 127Y to calculate correction data for correcting the pixel position in the sub-scanning direction in image data by the laser luminance modulation unit 128Y. More specifically, the correction amount calculation unit 127Y calculates the integral and decimal parts of the accumulated position error Δx, and generates the correction data based on the calculation results.

The correction amount calculation unit 127Y sets the calculation result of the integral part of Δx as data for correcting the pixel position in image data in the sub-scanning direction. For example, the correction amount calculation unit 127Y outputs correction data for advancing the pixel of interest at each sub-scanning position by two lines for Δx=2 and delaying it by one line for Δx=−1. Based on the calculation result of the decimal part of Δx, the correction amount calculation unit 127Y outputs data for correcting the densities of the pixel of interest and a pixel on the next line in image data.

In 17*b* of FIG. 17, the decimal part of Δx is 0.25, and each pixel at the sub-scanning position needs to be advanced by a 0.25 line. In this case, let P(N) be the exposure intensity of the pixel of interest on line N, Ph(N) be the corrected exposure intensity, Ph(N+1) be the exposure intensity of the next line N+1 adjacent to line N in the sub-scanning direction, and Ph(N+1) be the corrected exposure intensity. Then, tone correction is executed based on $$Ph(N)=(1-0.25)*P(N)$$

$$Ph(N+1)=0.25*P(N+1)$$

When the decimal part is 0, as shown in 17*a* of FIG. 17, the density of each pixel at the sub-scanning position need not be corrected, and the level is 255. To the contrary, when the decimal part is 0.25, as shown in 17*b* of FIG. 17, the density level of the pixel of interest at the sub-scanning position is 191, and that of a pixel on one preceding line is 64. Similarly, when the decimal part is 0.5, as shown in 17*c* of FIG. 17, both the density level of the pixel of interest at the sub-scanning position and that of a pixel on one preceding line are 128. By adjusting the pixel density in this way, the position of an electrostatic latent image formed on the photosensitive drum 5Y can be corrected at a resolution smaller than one dot, as shown in 17*b* and 17*c* of FIG. 17.

Figure 14:
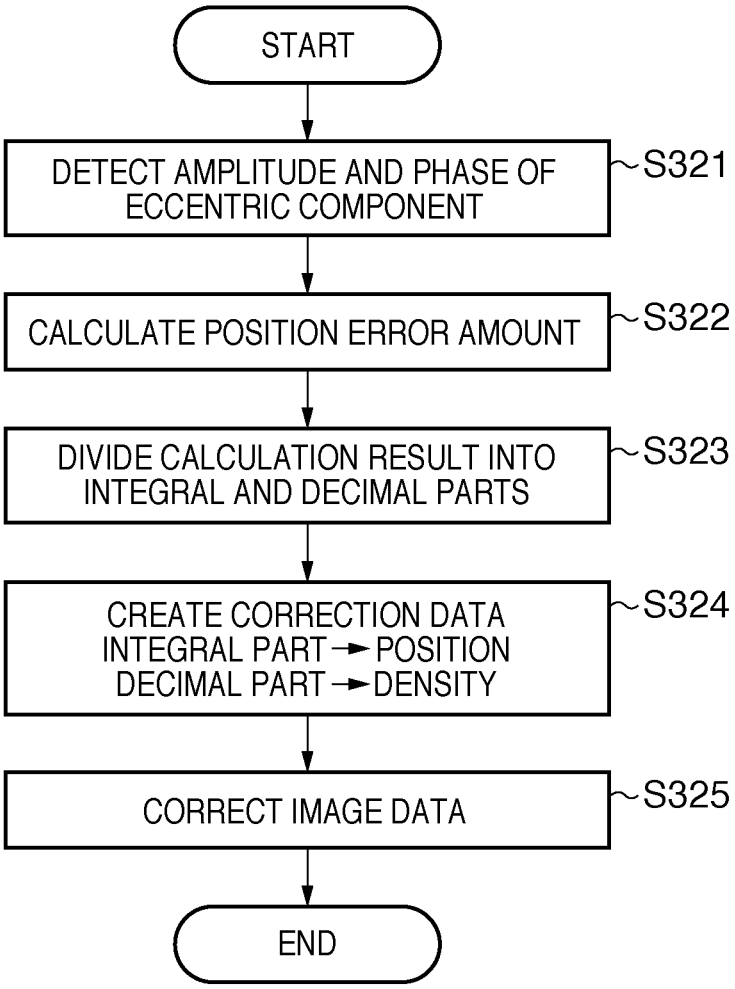
FIG. 14 is a flowchart showing control procedures by an exposure control unit according to the fourth embodiment.

FIG. 14 is a flowchart showing control procedures by the exposure control unit 163 according to the fourth embodiment. In S321, the exposure control unit 163 detects the amplitude (eccentric amount) and phase of the eccentric component of the photosensitive drum 5. In S322, the exposure control unit 163 detects the speed of surface of the photosensitive drum 5 at the exposure position or the magnitude of a position error at each sub-scanning position, based on the detection result of S321. Then, the process shifts to S323.

In S323, the exposure control unit 163 uses the correction amount calculation unit 127Y to divide the calculation result of the position error in S322 into integral and decimal parts. In S324, the exposure control unit 163 creates correction data (table) for converting the integral part into position correction information and the decimal part into density correction information. In S325, the exposure control unit 163 corrects image data based on the table created in S324, and controls exposure on the photosensitive drum 5Y.

In the above description, one pixel in image data is expressed by the saturation density, but halftone is also used in actual image data. In this case, it suffices to adjust the exposure intensity by multiplying the densities of the pixel of interest and an adjacent pixel by, as correction data, the ratio for correcting a position error. To increase the correction precision, it is preferable to grasp in advance a characteristic displacement amount based on the arrangement of the image forming apparatus, and hold it as a table in S324 of FIG. 14.

As described above, the image forming apparatus according to the fourth embodiment makes the rotational speed of the scanner motor close to a constant speed, and corrects the density of image data based on the speed of surface of the photosensitive drum at the exposure position. More specifically, the position of each pixel of image data is moved back and forth in the sub-scanning direction based on the speed of surface. In addition, the densities of the pixel of interest and an adjacent pixel are corrected in the sub-scanning direction, controlling the exposure intensity on the photosensitive drum. Even if the rotational speed of the scanner motor is set constant without correcting the exposure timing, electrostatic latent images can be formed at constant intervals on the photosensitive drum. Similar to the first to third embodiments, an image free from any AC color registration error can be formed on the intermediate transfer member based on the latent images.

Other Embodiments

Aspects of the present invention can also be realized by a computer of a system or apparatus (or devices such as a CPU or MPU) that reads out and executes a program recorded on a memory device to perform the functions of the above-described embodiment(s), and by a method, the steps of which are performed by a computer of a system or apparatus by, for example, reading out and executing a program recorded on a memory device to perform the functions of the above-described embodiment(s). For this purpose, the program is provided to the computer for example via a network or from a recording medium of various types serving as the memory device (for example, computer-readable medium).

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2009-234644, filed Oct. 8, 2009, which is hereby incorporated by reference herein in its entirety.

What is claimed is:

1. An image forming apparatus including an image carrier, an exposure unit that forms an electrostatic latent image by exposing a surface of the image carrier based on image data, a developing unit that develops the electrostatic latent image formed on the image carrier with a developing material, and an intermediate transfer member onto which a developing material image developed by the developing unit is transferred, the apparatus comprising:

a first detection unit that detects a speed of a surface of the intermediate transfer member at a transfer position where the developing material image is transferred from the image carrier to the intermediate transfer member;

a first control unit that controls driving of the intermediate transfer member based on a result of the detection by said first detection unit so as to make the speed of the surface of the intermediate transfer member at the transfer position close to a predetermined target speed;

a second detection unit that detects a speed of the surface of the image carrier at the transfer position;

a second control unit that controls driving of the image carrier based on a result of the detection by said second detection unit so as to make the speed of the surface of the image carrier at the transfer position close to the same speed as the speed of the surface of the intermediate transfer member at the transfer position;

a third detection unit that detects a speed of the surface of the image carrier at an exposure position where the image carrier is exposed by the exposure unit; and a third control unit that controls a timing of exposure by the exposure unit based on a result of the detection by said third detection unit so as to make an interval to expose the image carrier by the exposure unit in a sub-scanning direction, close to a constant interval.

2. The apparatus according to claim 1, further comprising:

a first speed sensor that is arranged near the transfer position and detects the speed of the surface of the intermediate transfer member; and a second speed sensor that is arranged at a position where said second speed sensor opposes said first speed sensor via the transfer position, and detects the speed of the surface of the intermediate transfer member, wherein said first detection unit includes a unit that estimates the speed of the surface of the intermediate transfer member at the transfer position based on a result of the detection by said first speed sensor and a result of the detection by said second speed sensor.

3. The apparatus according to claim 2, further comprising:

a fourth detection unit that detects a rotational speed of a driving shaft of the image carrier; and a third speed sensor that detects a speed of the surface of the image carrier at a position different from the transfer position and the exposure position, wherein said second detection unit includes a unit that estimates the speed of surface of the image carrier at the transfer position based on a result of the detection by said fourth detection unit and a result of the detection by said third speed sensor, and said third detection unit includes a unit that estimates the speed of the surface of the image carrier at the exposure position based on the result of the detection by said fourth detection unit and the result of the detection by said third speed sensor.

4. The apparatus according to claim 2, further comprising:

a third speed sensor that detects a speed of the surface of the image carrier at a position different from the transfer position; and a fourth speed sensor that detects a speed of the surface of the image carrier at a position different from the transfer position and the position of said third speed sensor, wherein said second detection unit includes a unit that estimates the speed of the surface of the image carrier at the transfer position based on a result of the detection by said third speed sensor and a result of the detection by said fourth speed sensor, and said third detection unit includes a unit that estimates the speed of the surface of the image carrier at the exposure position based on the result of the detection by said third speed sensor and the result of the detection by said fourth speed sensor.

5. The apparatus according to claim 1, further comprising:

a fourth detection unit that detects a rotational speed of a driving shaft of the image carrier, wherein said third detection unit includes a unit that estimates the speed of the surface of the image carrier at the exposure position based on a result of the detection by said fourth detection unit and the result of the detection by said second detection unit.

6. The apparatus according to claim 1, wherein said third control unit includes:

a unit that calculates a timing to start exposure in a main scanning direction based on the result of the detection by said third detection unit so as to make the interval to expose the image carrier in the sub-scanning direction, close to a constant interval, and a unit that calculates a time period of scanning and a scanning frequency for exposure in the main scanning direction based on the result of the detection by said third detection unit, and said third control unit controls the exposure unit based on the determined start timing, the determined time period of scanning, and the determined scanning frequency.

7. The apparatus according to claim 1, wherein said third control unit controls an exposure intensity by correcting the image data to eliminate a position error in the sub-scanning direction that is obtained based on the result of the detection by said third detection unit, instead of controlling the timing of exposure by the exposure unit.

8. A method of controlling an image forming apparatus including an image carrier, an exposure unit that forms an electrostatic latent image by exposing a surface of the image carrier based on image data, a developing unit that develops the electrostatic latent image formed on the image carrier with a developing material, and an intermediate transfer member onto which a developing material image developed by the developing unit is transferred, the method comprising:

detecting a speed of a surface of the intermediate transfer member at a transfer position where the developing material image is transferred from the image carrier to the intermediate transfer member;

controlling driving of the intermediate transfer member based on a result of the detection in the detecting step of the speed of the surface of the intermediate transfer member at a transfer position, so as to make the speed of the surface of the intermediate transfer member at the transfer position close to a predetermined target speed;

detecting a speed of the surface of the image carrier at the transfer position;

controlling driving of the image carrier based on a result of the detection in the detecting step of the speed of the surface of the image carrier at the transfer position, so as to make the speed of the surface of the image carrier at the transfer position close to the same speed as the speed of the surface of the intermediate transfer member at the transfer position;

detecting a speed of the surface of the image carrier at an exposure position where the image carrier is exposed by the exposure unit; and controlling a timing of exposure by the exposure unit based on a result of the detection in the detecting step of the speed of the surface of the image carrier at an exposure position, so as to make an interval to expose the image carrier by the exposure unit in a sub-scanning direction, close to a constant interval.

* * * * *